US010760267B2

(12) United States Patent
Matys

(10) Patent No.: US 10,760,267 B2
(45) **Date of Patent: *Sep. 1, 2020**

(54) METHOD AND MOLD FOR MANUFACTURING AN INTERLOCKING CONCRETE RETAINING WALL BLOCK

(71) Applicant: RISI STONE INC., Newmarket (CA)

(72) Inventor: Tyler Matys, Newmarket (CA)

(73) Assignee: RISI STONE INC., Newmarket, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/916,400

(22) Filed: Mar. 9, 2018

(65) Prior Publication Data

US 2018/0195276 A1 Jul. 12, 2018

Related U.S. Application Data

(62) Division of application No. 14/704,621, filed on May 5, 2015, now Pat. No. 9,945,118.

(51) Int. Cl.
*B28B 3/04* (2006.01)
*E04B 2/84* (2006.01)
(Continued)

(52) U.S. Cl.
CPC ..... *E04B 2/84* (2013.01); *B28B 1/14* (2013.01); *B28B 3/04* (2013.01); *B28B 7/007* (2013.01);
(Continued)

(58) Field of Classification Search
CPC .... B28B 1/14; B28B 1/00; B28B 3/02; B28B 3/021; B28B 3/00; B28B 3/04;
(Continued)

(56) References Cited

U.S. PATENT DOCUMENTS 3,426,122 A * 2/1969 Gaudelli ..... B28B 7/007 249/127
2009/0000234 A1 1/2009 Bott et al.
(Continued)

*Primary Examiner* — Xiao S Zhao
*Assistant Examiner* — Ninh V Le
(74) *Attorney, Agent, or Firm* — Sughrue Mion, PLLC

(57) ABSTRACT

A mold for manufacturing interlocking, dry-cast concrete retaining wall blocks in an upright orientation comprises a mold box comprising two side walls joined to end walls to define a mold cavity, a top face, and a substantially open bottom face. Partitions configured to define a space between adjacent blocks or a space between a block and a side of the mold box extend parallel to the side walls of the mold box substantially from the top face into the mold cavity, to form first transverse portions of the profile of the top and bottom surfaces the blocks which do not include any undercut portion that would impede removal of the mold box in a substantially vertical direction. At least one removable insert comprises insert members which, when positioned in the mold box beneath the partitions, form remaining transverse portions of the profile of the top and bottom surfaces, the remaining transverse portions including at least one undercut portion. The insert members, when in position in the mold box for casting, are substantially in lateral alignment with respective bottom surfaces of at least some of the partitions and can be inserted and retracted through openings in an end wall of the mold box.

6 Claims, 25 Drawing Sheets

(51) Int. Cl.

| | |
|---|---|
| ***B28B 1/14*** | (2006.01) |
| ***B28B 7/00*** | (2006.01) |
| ***B28B 7/18*** | (2006.01) |
| ***B28B 7/20*** | (2006.01) |
| ***B28B 7/24*** | (2006.01) |
| ***B28B 7/28*** | (2006.01) |
| *B28B 7/26* | (2006.01) |

(52) U.S. Cl.
CPC ..... *B28B 7/0064* (2013.01); *B28B 7/0073* (2013.01); *B28B 7/0079* (2013.01); *B28B 7/0082* (2013.01); *B28B 7/0097* (2013.01); *B28B 7/183* (2013.01); *B28B 7/20* (2013.01); *B28B 7/24* (2013.01); *B28B 7/285* (2013.01); *B28B 7/26* (2013.01)

(58) Field of Classification Search
CPC ..... B28B 7/0073; B28B 7/007; B28B 7/0082; B28B 7/183; B28B 7/20; B28B 7/24; B28B 7/26; B28B 7/0097; B28B 7/285; B28B 7/0064; B28B 7/0079; B28B 7/28; E04B 2/84
See application file for complete search history.

(56) References Cited

U.S. PATENT DOCUMENTS

2015/0151450 A1* 6/2015 Matys ..... B28B 7/0079 264/333
2016/0326743 A1* 11/2016 Matys ..... B28B 7/007

* cited by examiner

METHOD AND MOLD FOR MANUFACTURING AN INTERLOCKING CONCRETE RETAINING WALL BLOCK

CROSS REFERENCE TO RELATED APPLICATIONS

This application is a divisional of U.S. application Ser. No. 14/704,621, filed May 5, 2015, the contents of which is incorporated herein by reference in its entirety.

FIELD OF THE INVENTION

This invention relates to prefabricated interlocking concrete blocks. In particular, this invention relates to a mold and method for manufacturing prefabricated interlocking dry-cast concrete blocks.

BACKGROUND OF THE INVENTION

Interlocking concrete blocks are used for many outdoor construction applications, one of the most common being the construction of retaining walls. Interlocking concrete blocks are thus designed for durability, stability and aesthetic appeal.

One of the ways that aesthetic appeal is imparted to a structure formed from interlocking concrete blocks is to make the exposed face look as much as possible like natural stone, or some other architectural texture. While this is possible using existing methods of wet-casting concrete into textured, rubber molds, the present invention provides a new, innovative way to impart textures, designs, colours and/or special treatments (such as face-mixes, for example) to the exposed face of a retaining wall block using conventional dry-cast concrete machinery and methods.

Currently, dry-casting concrete blocks has many advantages over wet-casting concrete blocks from a production efficiency and economic point of view. In dry-casting, rigid steel molds are used to compress a "dry" mix of concrete into specific shapes (such as blocks or paving stones). Due to the minimal amount of water contained in the concrete mix, the blocks can be demolded almost immediately after they are compressed (molded). This allows the manufacturer to produce a layer of blocks in a matter of seconds, and immediately re-use the mold.

In comparison, wet-cast concrete blocks are created by pouring a wet, flowable concrete mix into non-rigid, malleable rubber mold. The concrete must be left to cure for a significant length of time (8-12 hrs) before the block can be demolded and the molds can be reused. As a result the cycle time is extremely long compared to dry-casting, the investment in the total number of rubber molds is significant, and the space requirements in the factory to store and manage these molds is significant. However, due to the pliable nature of the rubber molds, it is possible to imprint natural textures and detail in the concrete block.

Despite the benefits of dry-casting concrete from a manufacturing and production efficiency point of view, the nature of the rigid steel molds and machinery used in production is such that the "appearance" of the face of the block has been limited. The invention described herein provides a novel way to impart decorative facings to a dry-cast retaining wall blocks, while still being able to create interlocking structures on the top and bottom surface of the blocks. The interlocking mechanism allows for shear resistance and greater structural stability when used as resist lateral earth pressures typical to a segmental retaining wall. Furthermore, the invention orients the critical "height" dimension of the block in a way that ensures substantially perfect dimensional accuracy, and therefore substantially perfect horizontal wall alignment.

Conventionally, dry-cast blocks are created by casting dry-mix concrete in a mold, with the exposed face of one block joined to the exposed face of another block, and breaking the blocks apart along a score line. This results in an essentially random topography on each exposed face of the block pair, which produces a natural 'look and feel'.

In a traditional mold box used for forming dry-cast concrete blocks the interior walls, which create the cavities that form the concrete blocks or other products, extend to the bottom of the mold box. As such, it is not possible to have a positive interlocking shape or protrusion since the mold box is extracted vertically from the concrete product. A positive protrusion on any interior mold wall would be an obstruction when the mold box is lifted vertically. In the case of interlocking concrete blocks in which a tongue extending along the top surface interlocks with a groove extending along the bottom surface, this essentially limits the blocks to being formed upright and in face-to-face pairs in the mold box, because the sides and rear faces are the only surfaces of the blocks that do not have a positive interlocking shape or protrusion.

For example, FIGS. 1A to 1L illustrate a typical molding process for a prior art interlocking concrete block 20. FIG. 1A shows a prior art mold 10 with a mold box 12 and a floor comprising a mold insert 14 in position for casting. The mold insert 14 has a profile with projecting features 5*a* designed to form the interlocking structures on the bottom of the block 20 (in the embodiment shown recesses 5) and projecting features 6*a* forming break lines 6, as shown in FIG. 1B. After dry mix concrete has been fed into the mold 10, shown in FIG. 1C, a press head 15 is actuated to consolidate the concrete 1. In the prior art blocks 20 shown the press head 15 also forms the top interlocking structures, ribs or "tongues" 4 complementary to the recesses 5, and break lines 6, as shown in FIG. 1C.

The steps in the prior art forming process are illustrated in FIGS. 1D to 1L. The mold box 14 is positioned (FIG. 1D) beneath the press head 15 and the mold box 12 is placed on the mold insert 14 (FIG. 1E). Concrete 1 is fed into the mold 10 (FIG. 1F) and the press head 15 is actuated to consolidate the concrete and form the top surface 22 of the block 20 (FIG. 1G), then the press head 15 is retracted (FIG. 1H). The mold insert 14 can be removed immediately due to the zero slump concrete mix and the consolidation by the press head (FIG. 1I), and the mold box 12 lifted off of the slab of joined blocks 20 (FIG. 1J), leaving the unbroken slab of blocks 20 on a board or pallet (not shown). After the concrete has cured for at least 12 hours, blades 7 are forcibly applied to the break lines to split the individual blocks 20 from the slab (FIG. 1K). The exposed faces of the blocks 20 manufactured in this fashion have a "split block" finish, shown in FIG. 1L, which has been an industry standard for over 25 years.

There are disadvantages to this manufacturing method. While the (complementary) topographies produced on the exposed faces by breaking the blocks apart looks natural, using this manufacturing method the manufacturer has no control over the final appearance of the exposed face of the block because the fracturing occurs randomly. This limits the profile of the exposed face, and occasionally blocks must be rejected because of over-breakage resulting in the exposed face having a damaged appearance. Also, the height of the concrete blocks is determined by the stroke of the press head, which is a moving part, and since the length of each stroke of the press head may be slightly different there is a commensurate variation in the heights of concrete blocks cast at different times. Furthermore, if a colour other than natural concrete is desired on the exposed face, the colour must be mixed into the entire volume of concrete so that the exposed face provides a uniform colour, which given the cost of some dyes can be very expensive.

One or more of the embodiments of the invention addresses one or more of these disadvantages. While embodiments of the invention are described in detail below, it will be appreciated that not every advantage of the present invention necessarily applies to every embodiment described or claimed herein.

BRIEF DESCRIPTION OF THE DRAWINGS

In drawings which illustrate an embodiment of the invention by way of example only.

DETAILED DESCRIPTION OF THE INVENTION

Figure 1A:
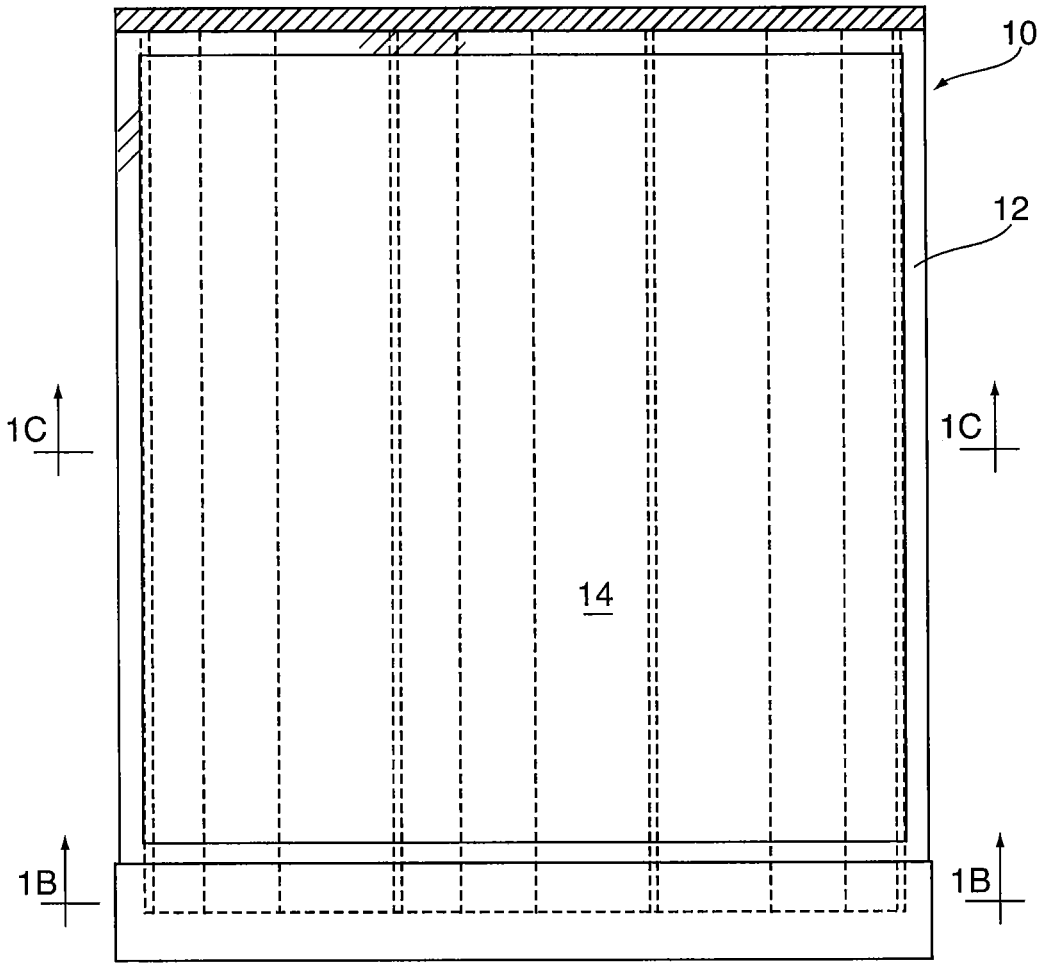
Fig. 1A PRIOR ART
FIGS. 1A to 1L are views showing a typical molding process for a prior art interlocking concrete block.
Figure 1B:
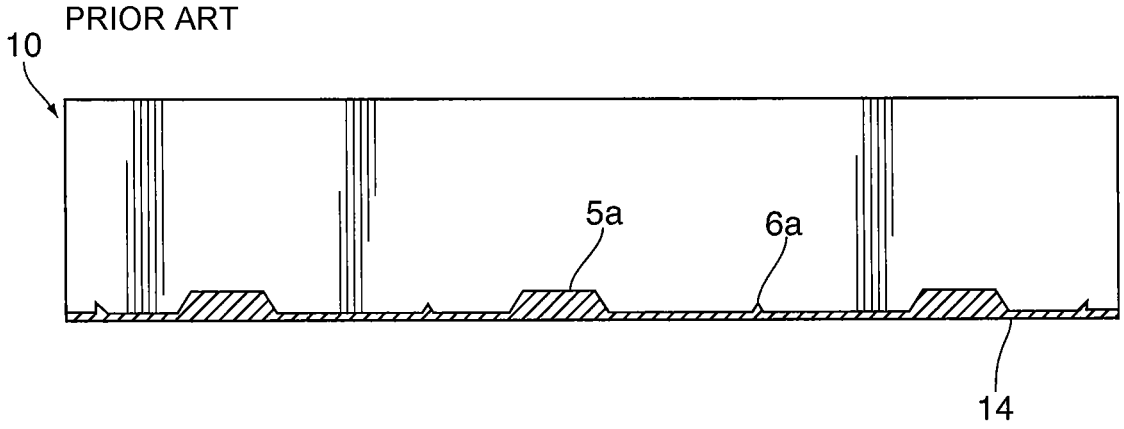
Fig. 1B PRIOR ART
Figure 1C:
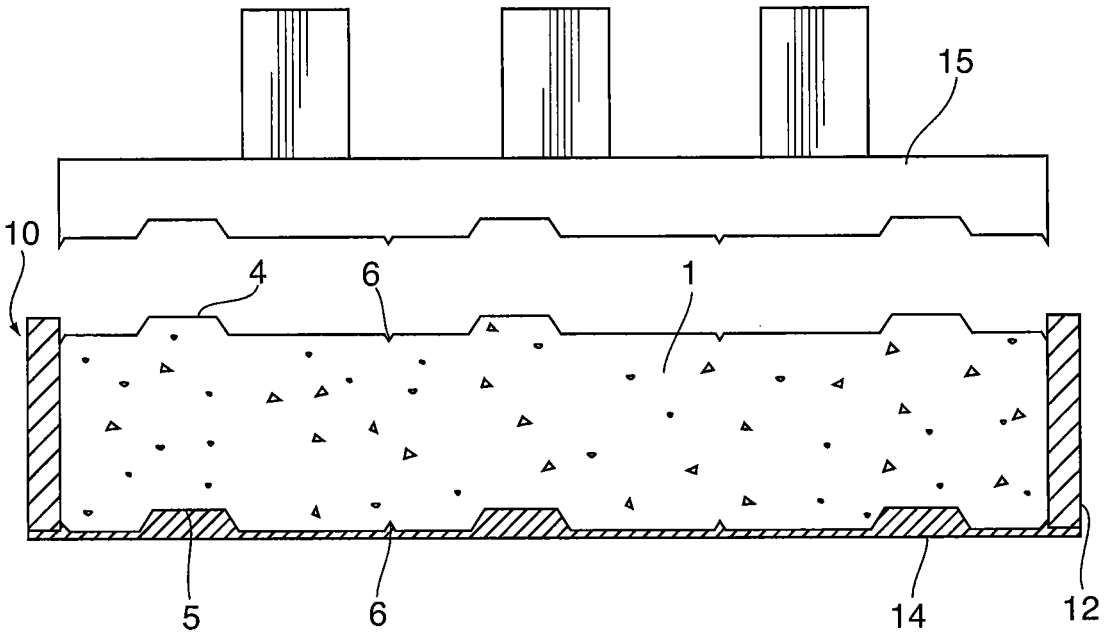
Fig. 1C PRIOR ART
Figure 1D:
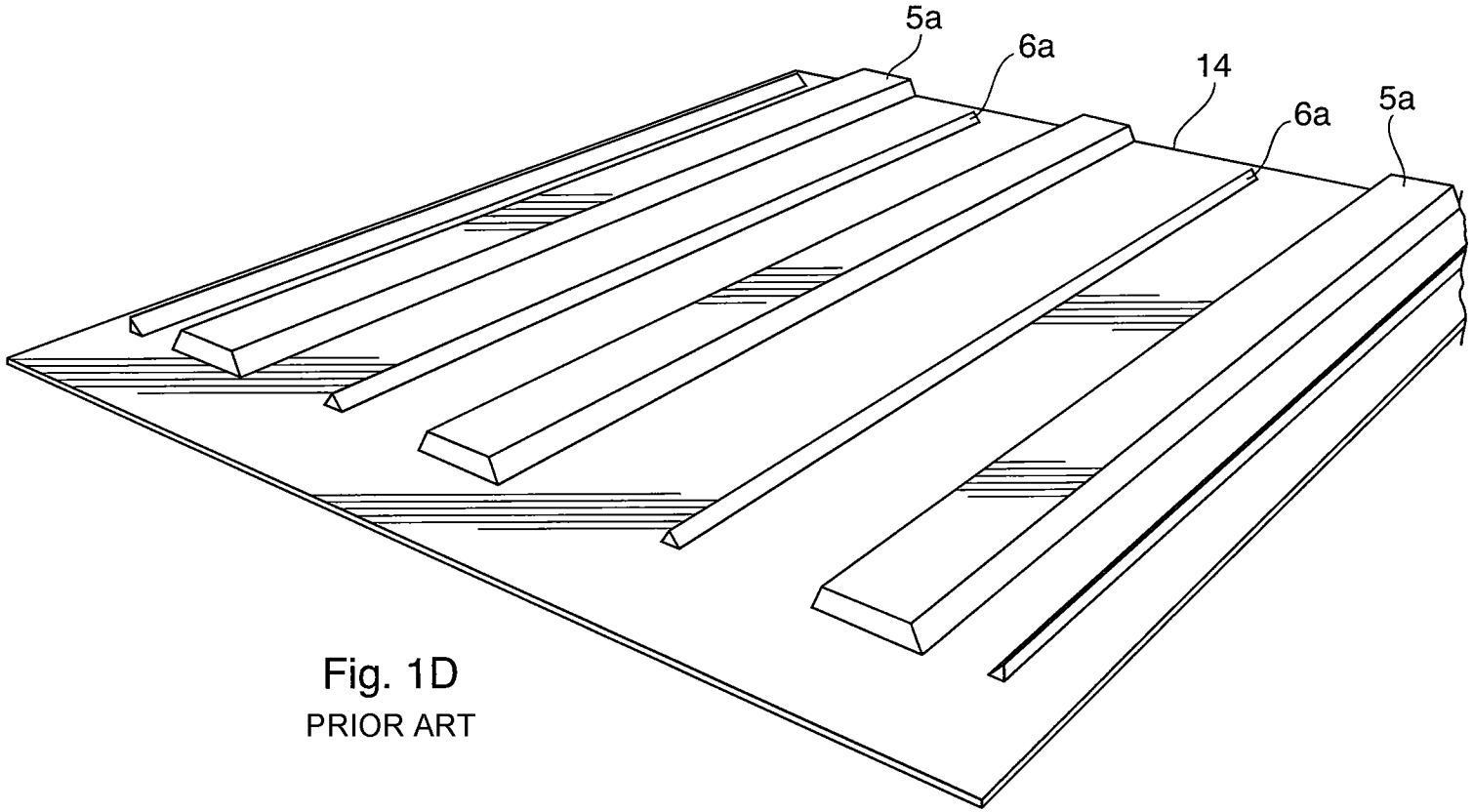
Fig. 1D PRIOR ART
Figure 1E:
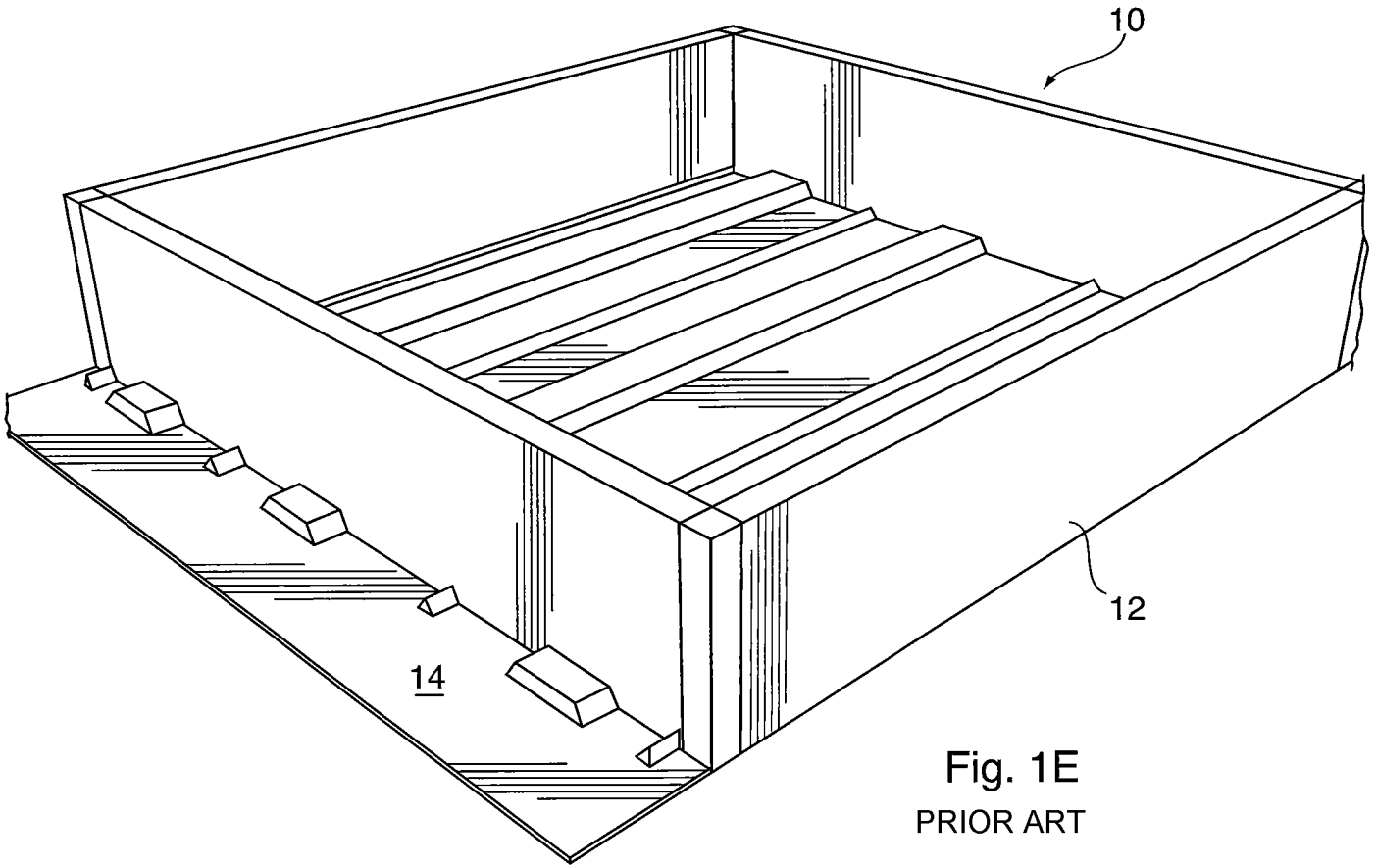
Fig. 1E PRIOR ART
Figure 1F:
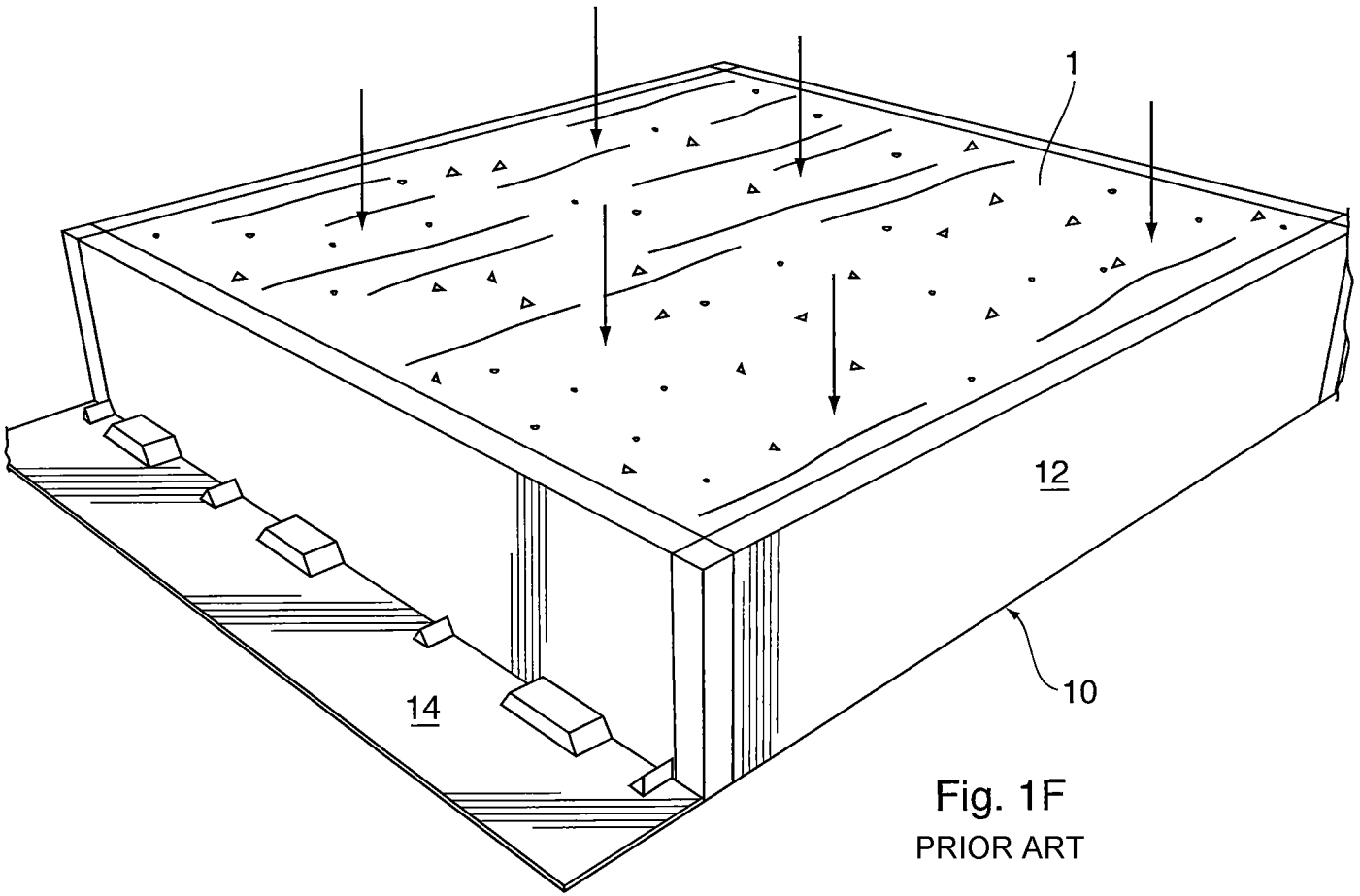
Fig. 1F PRIOR ART
Figure 1G:
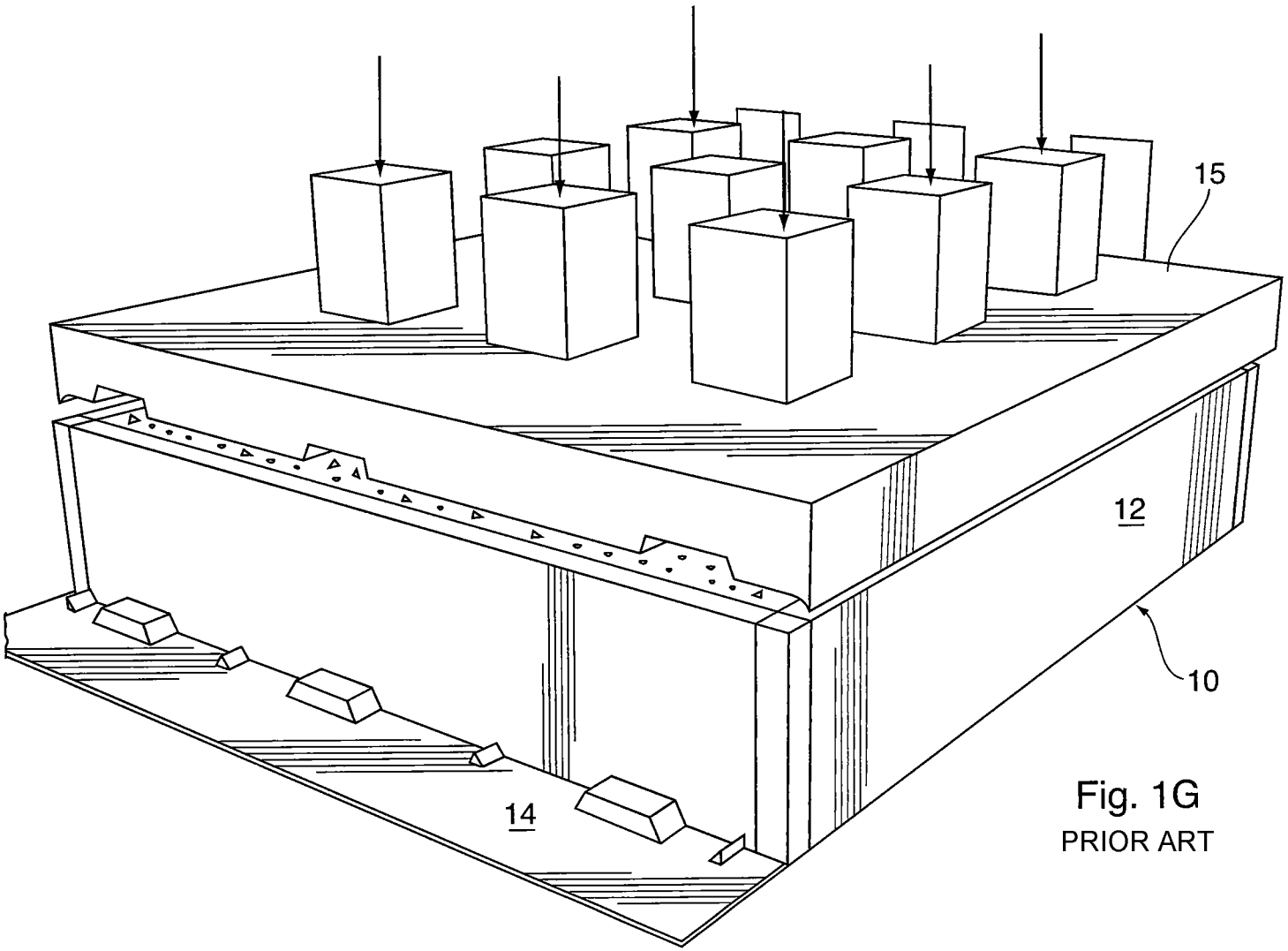
Fig. 1G PRIOR ART
Figure 1H:
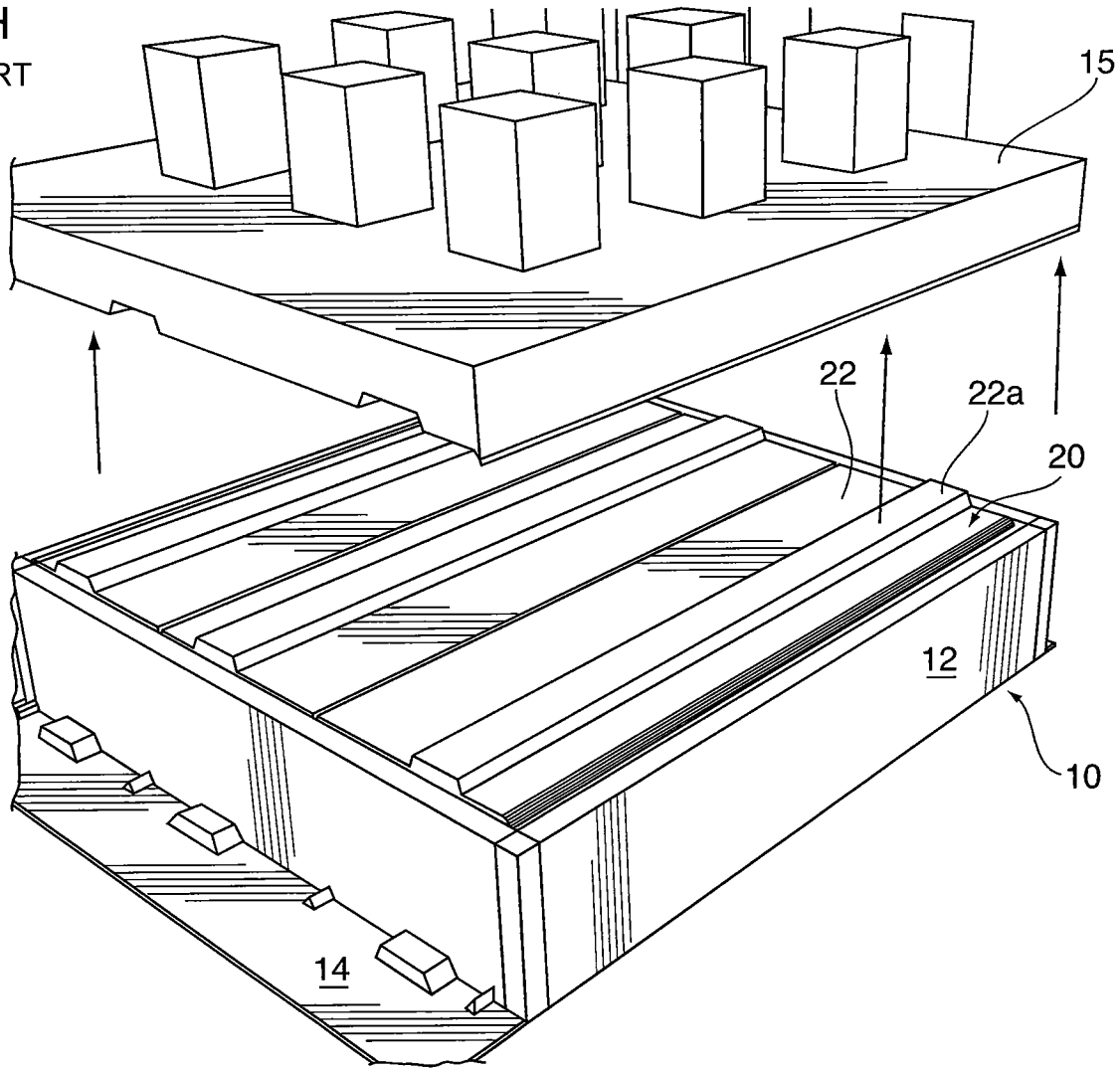
Fig. 1H PRIOR ART
Figure 1I:
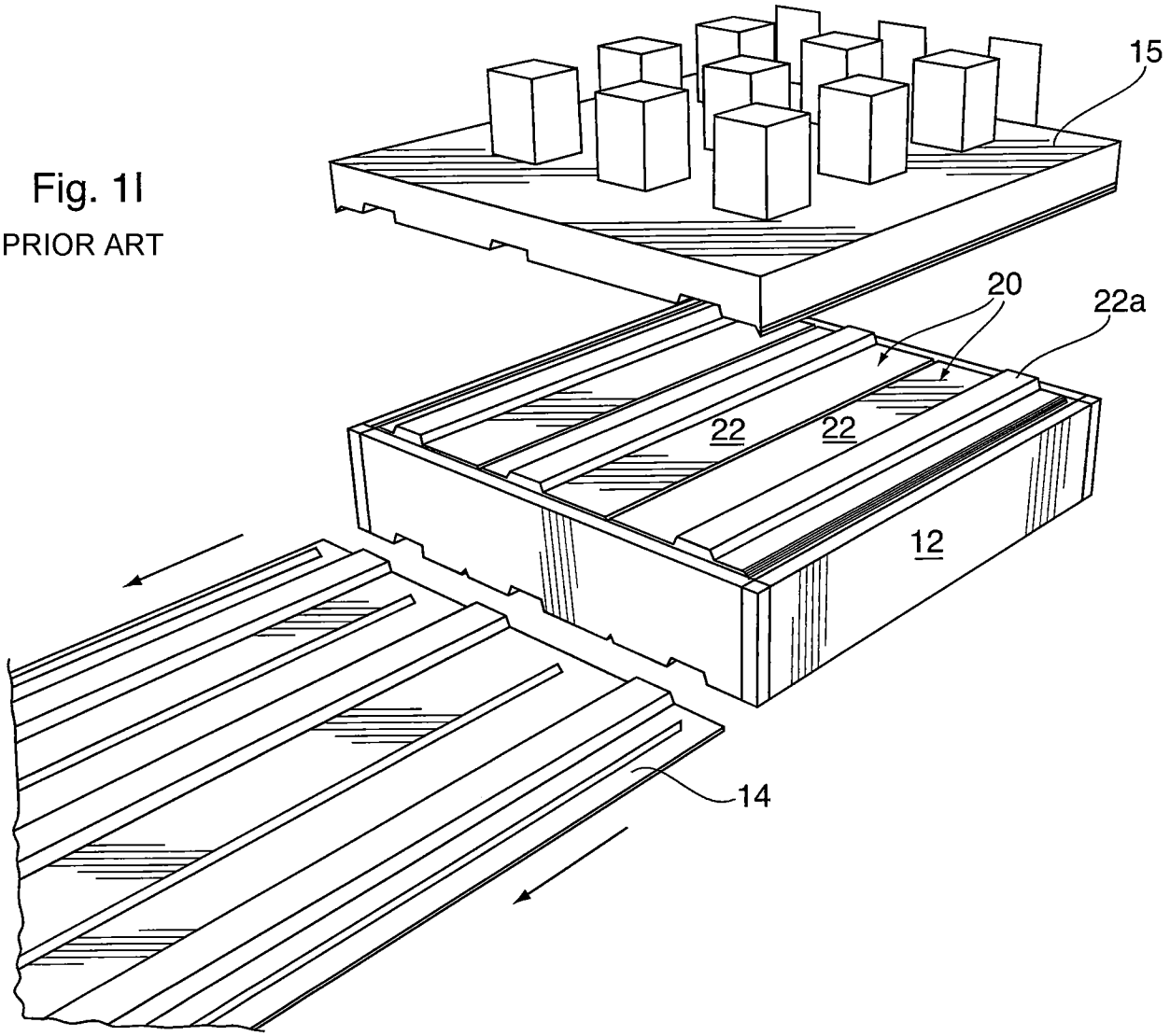
Fig. 1I PRIOR ART
Figure 1J:
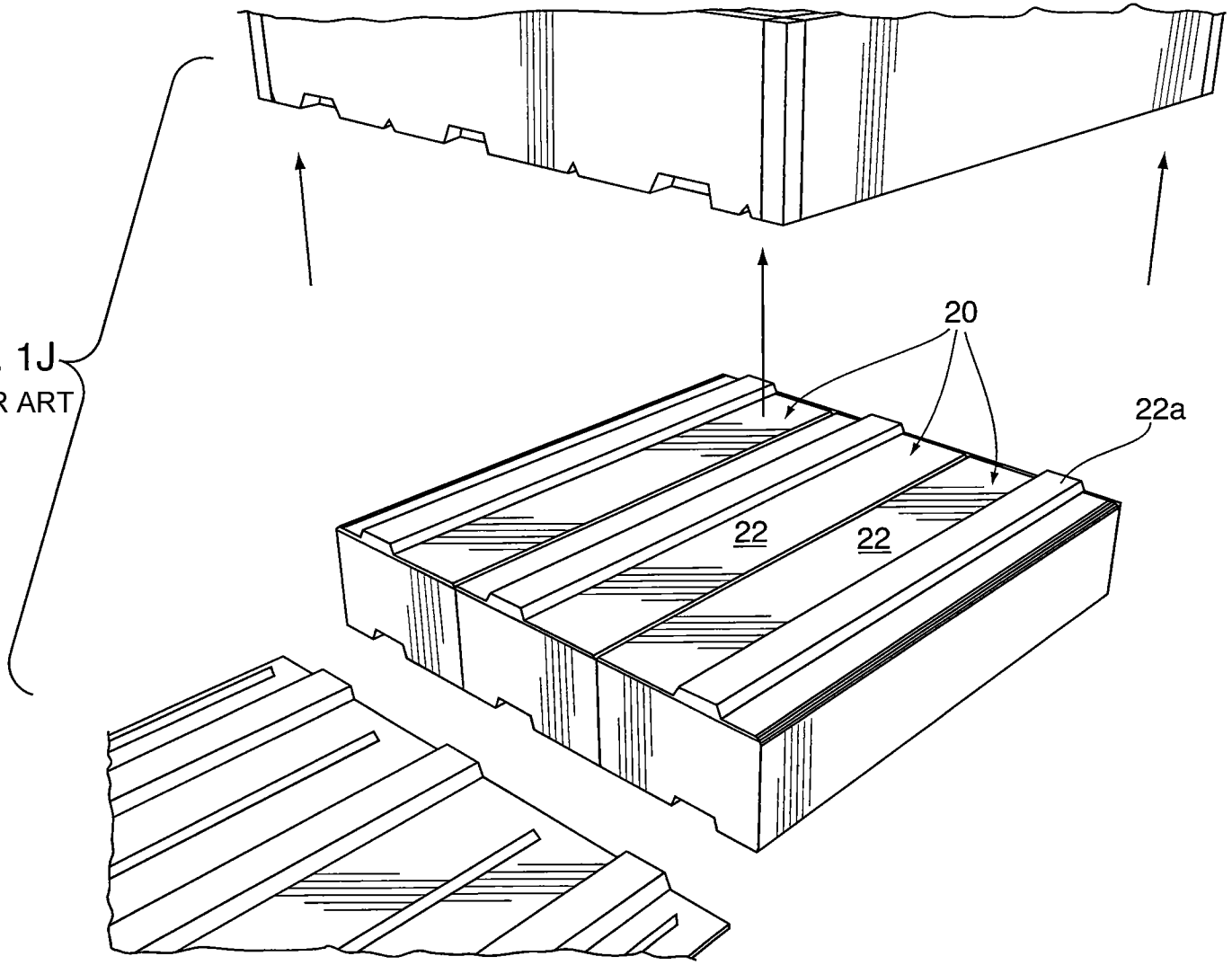
Fig. 1J PRIOR ART
Figure 1K:
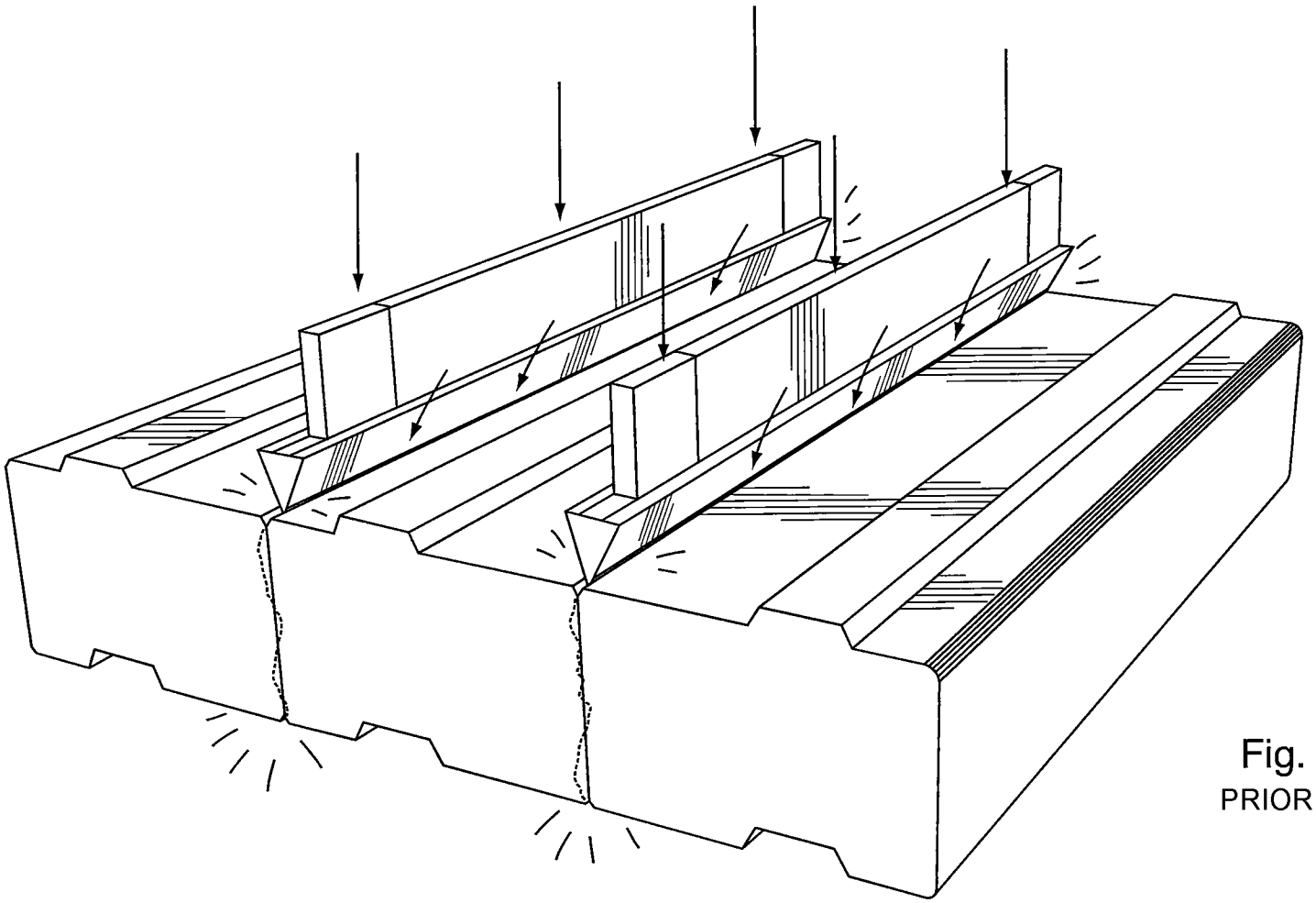
Fig. 1K PRIOR ART
Figure 1L:
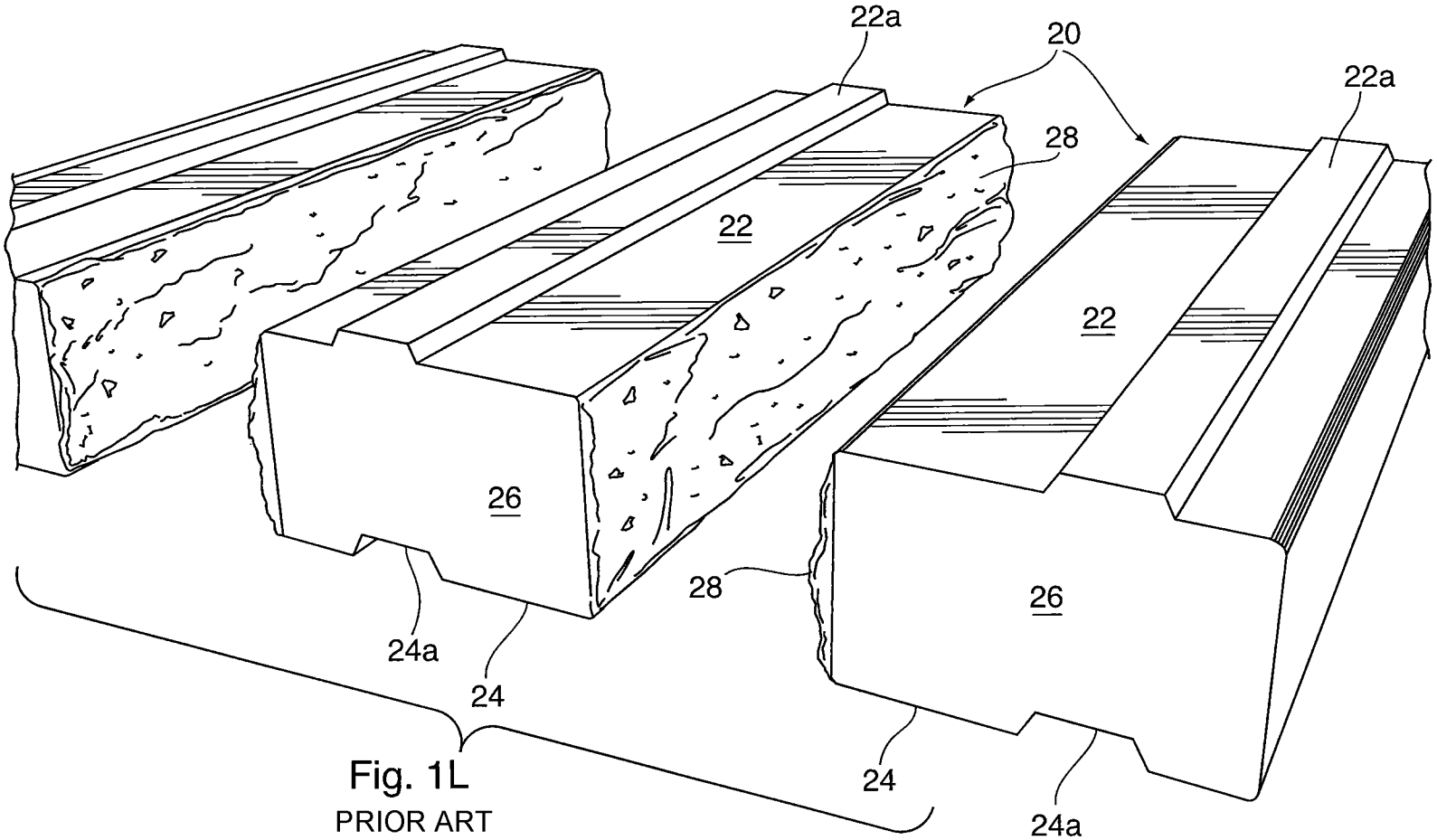
Fig. 1L PRIOR ART
Figure 2:
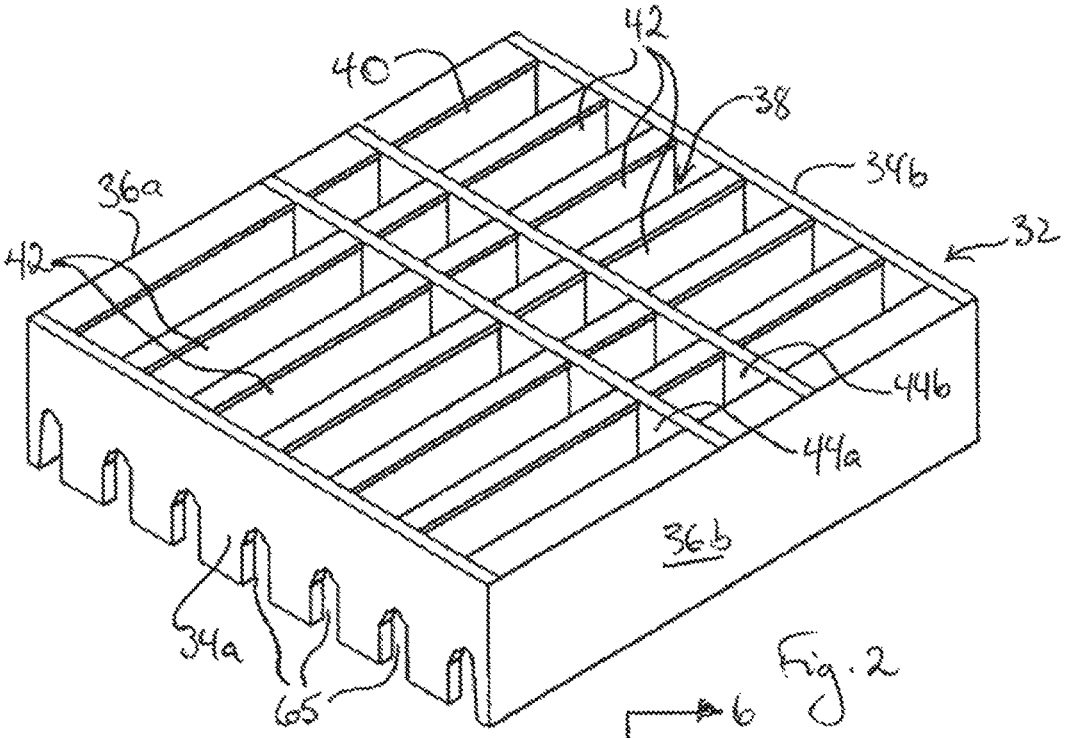
FIG. 2 is a perspective view of an embodiment of a mold box according to the invention.
Figure 3:
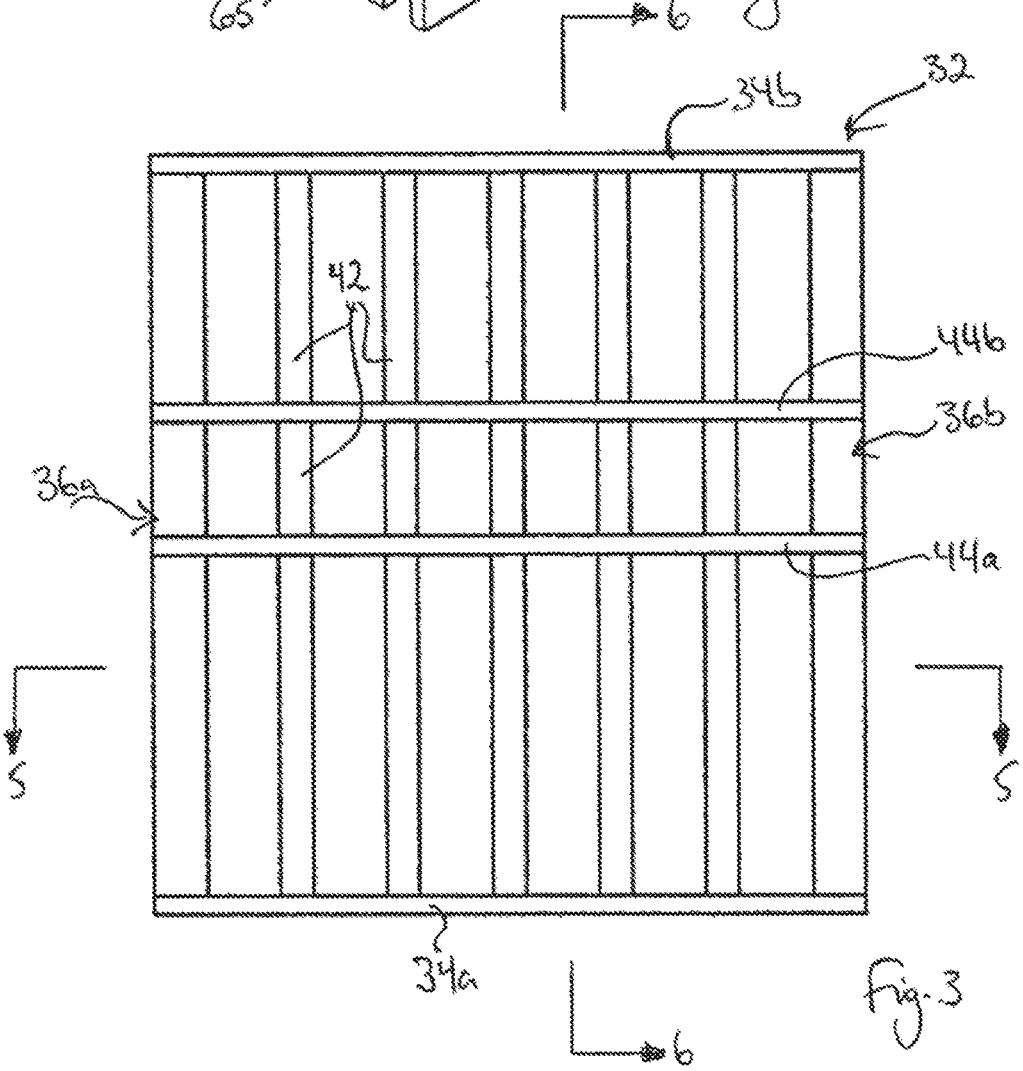
FIG. 3 is a plan view of the mold box of FIG. 2.
Figure 4:
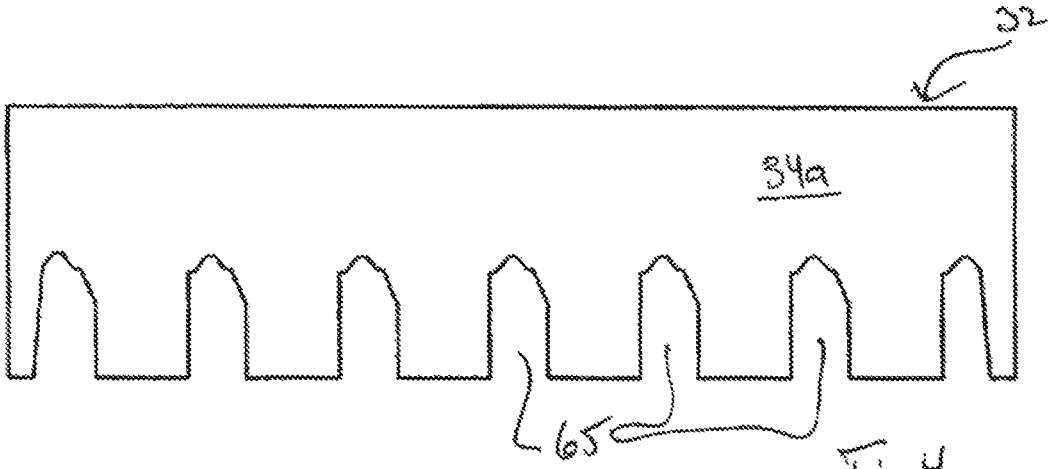
FIG. 4 is an end elevation of the mold box of FIG. 2.
Figure 5:
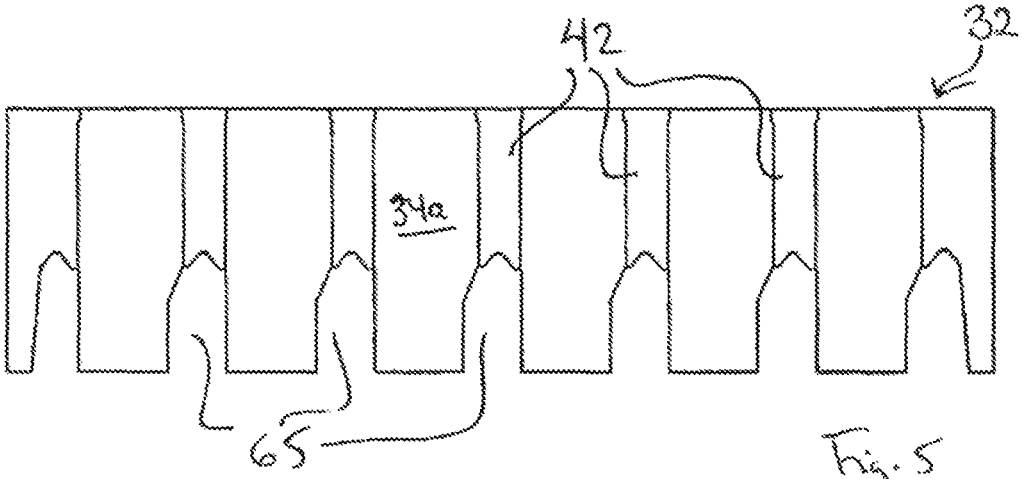
FIG. 5 is a cross-section of the mold taken along the line 5-5 in FIG. 3.
Figure 6:
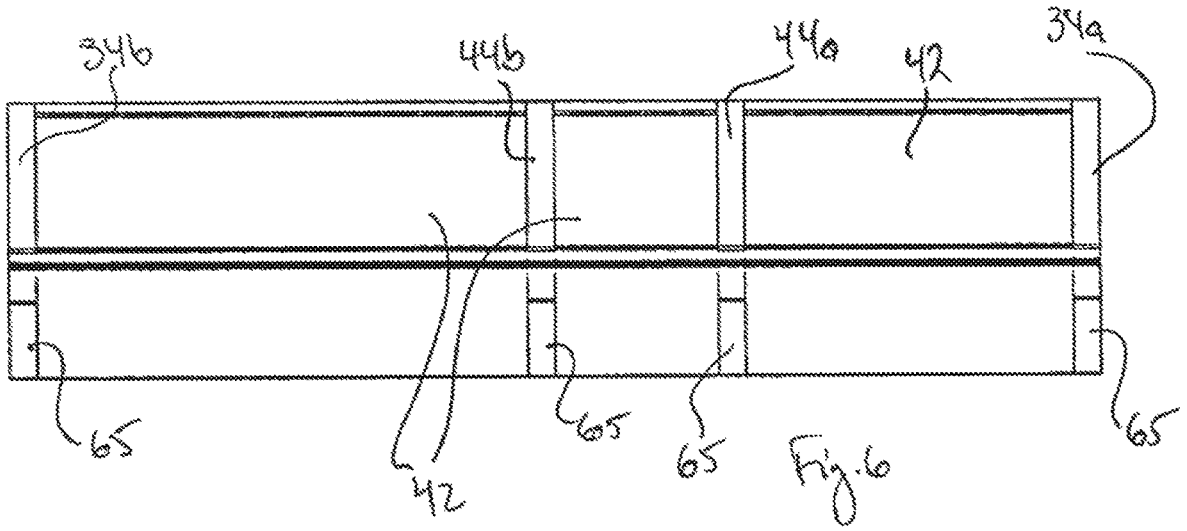
FIG. 6 is a cross-section of the mold taken along the line 6-6 in FIG. 3.
Figure 7:
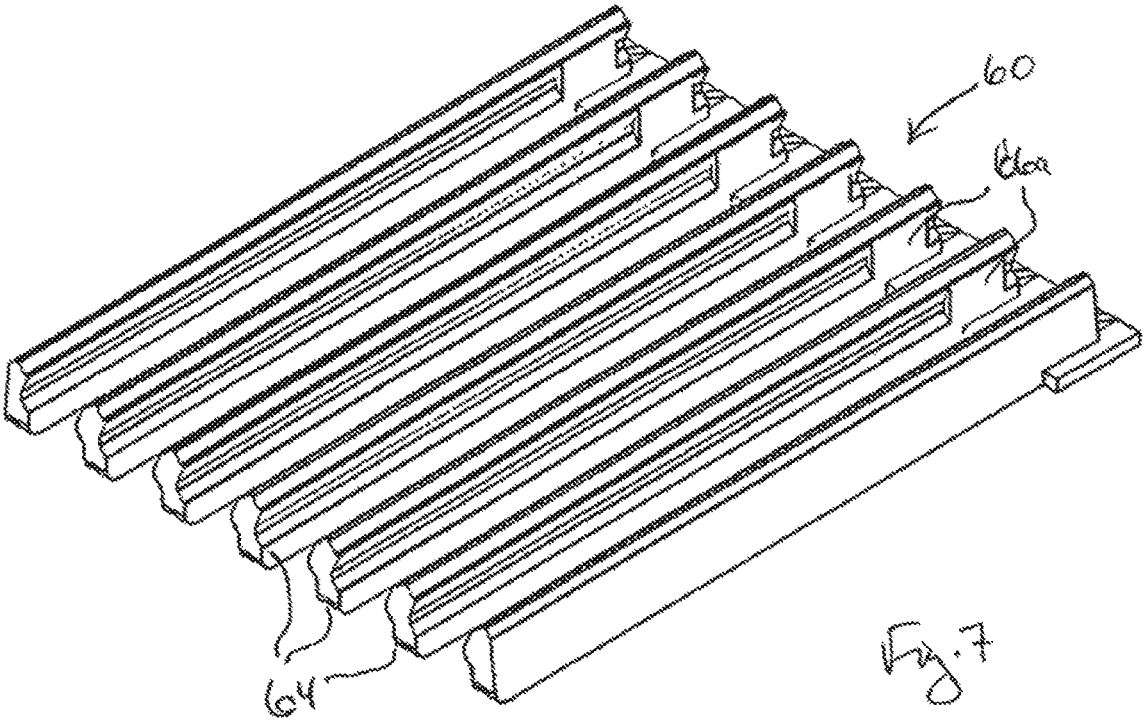
FIG. 7 is a perspective view of an embodiment of a mold insert according to the invention.
Figure 8:
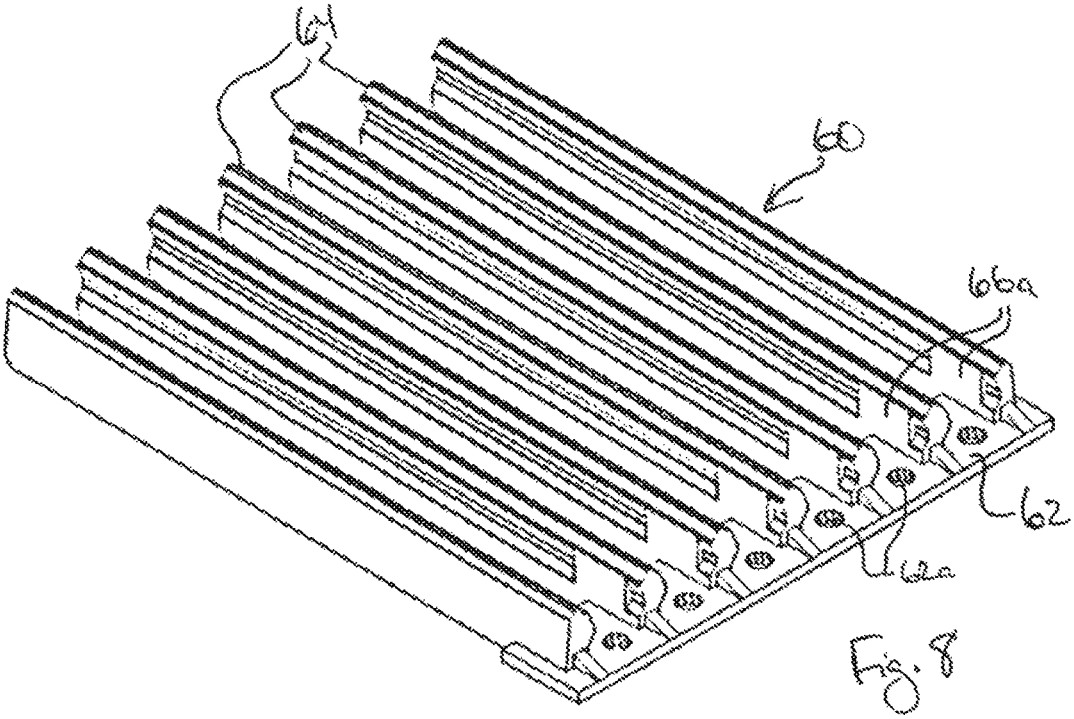
FIG. 8 is a perspective view of the mold insert taken opposite FIG. 7.
Figure 9:
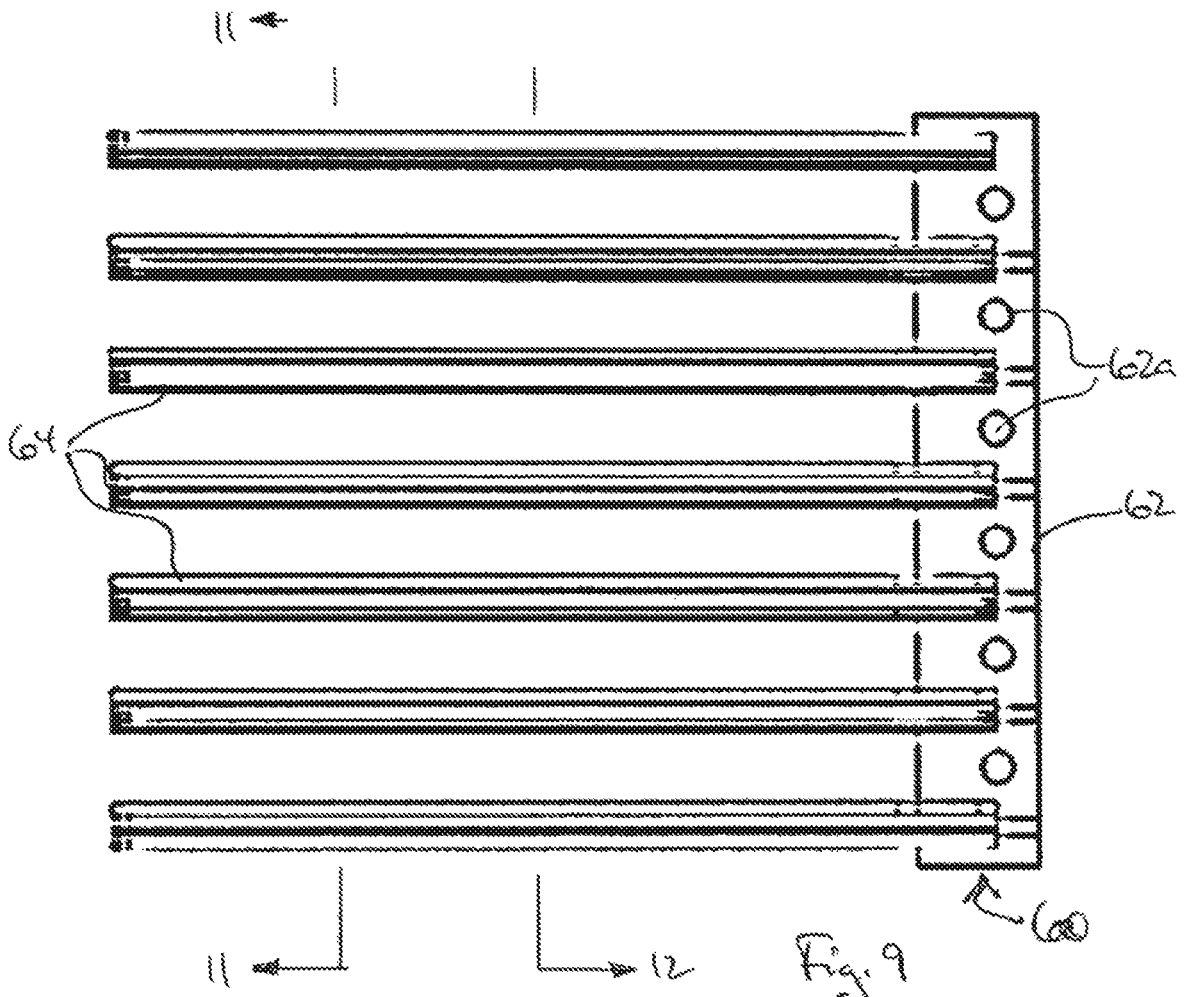
FIG. 9 is a top plan view of the mold insert of FIG. 7.

The present invention provides a mold for and method of manufacturing an interlocking, Dry-Cast Concrete block 20 which has an exposed face to which fully controllable custom textures and profiles can be applied with a press head 15, in some embodiments without removing the blocks 20 from the mold box. The exposed faces of the blocks 20 can also be coloured as desired, using a minimal amount of expensive concrete pigment in a face coat which can be as little as 10-15 mm thick. The height tolerance of each block 20 is determined by sturdy, fixed structures within the mold itself, rather than by a moving press head as in the prior art technique described above, and is therefore highly precise so that each block is substantially identical in height with all other blocks cast in the same mold. This is a major benefit for ease of installation compared to prior art systems. By changing the orientation of the blocks 20 within the mold, particularly with the exposed face 28 facing upwardly, the potential for changing the aesthetics of the exposed block face 28 is significantly increased.

The invention accomplishes this by providing, in a preferred embodiment, a mold 30 in which the interlocking concrete blocks are cast in an orientation such that their exposed faces 28 are at the top of the mold 30. The blocks 20 are thus oriented such that the top surface 22 of one block 20 is adjacent to the bottom surface 24 of the block 20 beside it (except for the outermost blocks which are adjacent to the wall 34 of the mold box 32). The mold box 32 for a typical block configuration is thus deeper than a prior art mold box 12, but commensurately smaller side-to-side so the footprint required for the casting process is reduced. Thus, interlocking concrete blocks 20 can be manufactured according to the method of the invention with a higher throughput for the same amount of floor space.

The applicants own co-pending U.S. patent application Ser. No. 14/093,710 filed Dec. 2, 2013 by Risi et al. for a Method and Mold For Manufacturing an Interlocking Concrete Block, which application is incorporated by reference herein in its entirety.

According to the present invention, the interior walls or 'partitions' 42 within the mold box 30 do not extend to the bottom of the mold box 30, but instead are aligned, and preferably mated in a positive interlock, with a set of profiled insert members 64 that are inserted into and withdrawn from the mold box 30 horizontally, and as such can form the positive interlocking structures 22*a*, 24*a* in the top and bottom surfaces 22, 24 of the block 20 without interfering with the vertical motion of the mold box 30. The top and bottom surfaces 22, 24 of the retaining wall block 20 are thus formed by two separate pieces: in the front portion F of the block 20 they are formed by the partitions 42 (and, for the end blocks, rigid mold walls 34, 36), while in the interlocking portion I and rear portion R they are formed by the profiled insert members 64.

As noted above, providing the exposed faces 28 of the interlocking concrete blocks 20 at the top of the mold 30 also allows for the application of a surface coat of face mix or another suitable, durable coating material to be applied while the blocks 20 are still in the mold 30. The exposed faces 28 may be coloured as desired without having to colour the concrete used for the body of the interlocking concrete block 20, and/or formed to any desired texture or profile.

The invention thus provides mold for manufacturing at least one interlocking concrete retaining wall block, the at least one block having a top surface having a transverse profile comprising at least one interlocking structure projecting from or recessed into the top surface, and a bottom surface having a transverse profile comprising at least one complementary interlocking structure projecting from or recessed into the bottom surface, the mold comprising: a mold box, comprising two side walls joined to end walls to define a mold cavity, a top face, and a substantially open bottom face, and partitions configured to define a space between adjacent blocks or a space between a block and a side of the mold box, extending substantially parallel to the side walls of the mold box substantially from the top face into the mold cavity, at least a longitudinal portion of at least some of the partitions being configured to form a first transverse portion of the profile of the top surface of one block or a first transverse portion of the profile of the bottom surface of an adjacent block, or both, wherein the first transverse portions do not include any undercut portion that would impede removal of the mold box in a substantially vertical direction; and at least one removable insert comprising insert members which, when positioned in the mold box beneath the partitions, extend substantially parallel to the side walls and are configured to occupy the space between adjacent blocks, or the space between a block and a side of the mold box, for forming a remaining transverse portion of the profile of the top surface of one block or a remaining transverse portion of the profile of the bottom surface of an adjacent block, or both, wherein the remaining transverse portions include at least one undercut portion; at least some of the insert members, when in position in the mold box for casting, having top surfaces being substantially in lateral alignment with respective bottom surfaces of at least some of the partitions, and at least one end of the mold box comprising openings through which the insert members can be inserted and retracted at least in a longitudinal direction.

The invention further provides a method of manufacturing a plurality of interlocking concrete retaining wall blocks each having a top surface having a transverse profile comprising at least one interlocking structure projecting from or recessed into the top surface and a bottom surface having a transverse profile comprising at least one complementary interlocking structure projecting from or recessed into the bottom surface, comprising the steps of: a. providing a mold box comprising two side walls joined to end walls to define a mold cavity, a top face, and a substantially open bottom face, and partitions configured to define a space between adjacent blocks or a space between a block and a side of the mold box, extending substantially parallel to the side walls of the mold box substantially from the top face into the mold cavity, at least a longitudinal portion of at least some of the partitions being configured to form a first transverse portion of the profile of the top surface of one block or a first transverse portion of the profile of the bottom surface of an adjacent block, or both, wherein the first transverse portions do not include any undercut portion that would impede removal of the mold box in a substantially vertical direction, and at least one removable insert comprising insert members which, when positioned in the mold box beneath the partitions, extend substantially parallel to the side walls and are configured to occupy the space between adjacent blocks, or the space between a block and a side of the mold box, for forming a remaining transverse portion of the profile of the top surface of one block or a remaining transverse portion of the profile of the bottom surface of an adjacent block, or both, wherein the remaining transverse portions include at least one undercut portion, b. inserting the insert members into the openings in the end of the mold box, such that top surfaces of at least some of the insert members are in substantially lateral alignment with respective bottom surfaces of at least some of the partitions; c. introducing concrete into the mold cavity; d. consolidating the concrete; e. in any order: i. removing the mold insert from the mold box, and ii. removing the formed blocks from the mold box.

Figure 20:
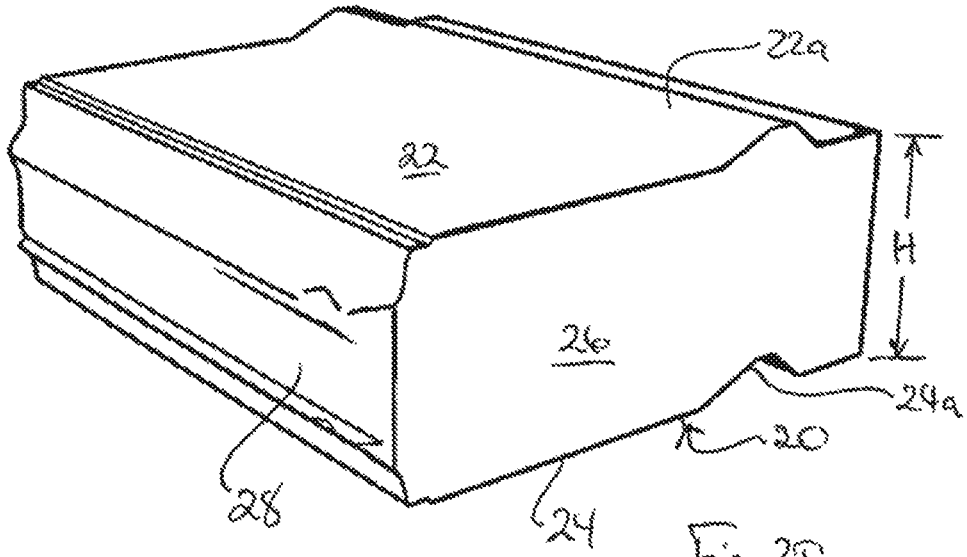
FIG. 20 is a perspective view of an interlocking retaining wall block produced by the mold and method of the invention.
Figure 21:
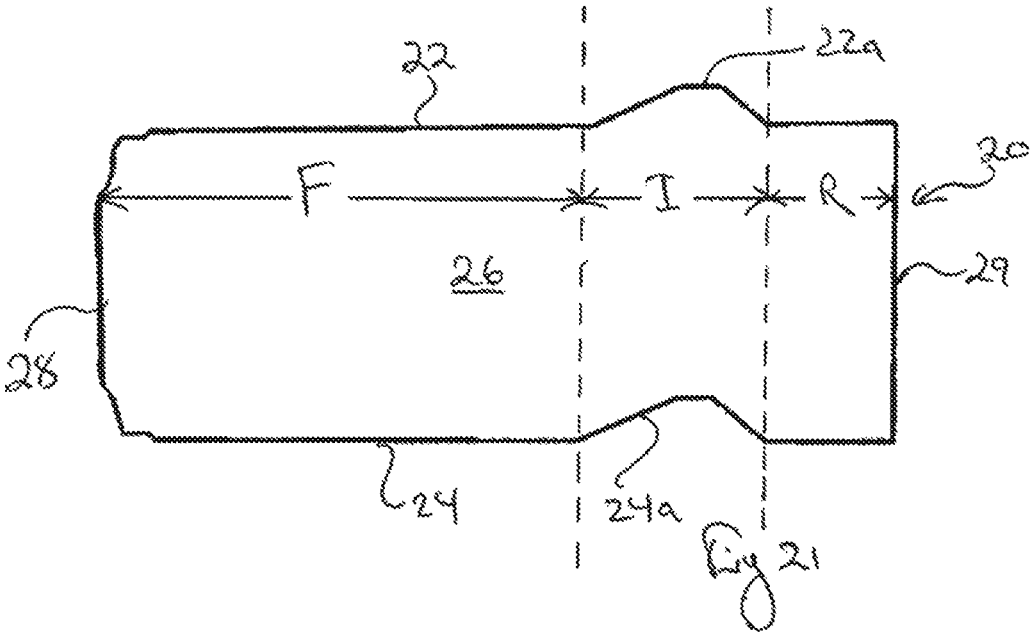
FIG. 21 is a side elevation of the retaining wall block of FIG. 20.

FIGS. 2 to 18 illustrate by way of non-limiting example the various components of a mold 30 for manufacturing a plurality of interlocking concrete blocks 20 according to the invention. The interlocking blocks 20 are advantageously of the type having a top surface 22 with a transverse profile comprising at least one interlocking structure projecting from or recessed into the top surface 22, in the embodiment shown a tongue 22*a*, and a bottom surface 24 having a transverse profile comprising at least one complementary interlocking structure projecting from or recessed into the bottom surface 24, in the embodiment shown a groove or recess 24*a* complementary to the tongue 22*a*, as illustrated in FIGS. 20 and 21.

Figure 22:
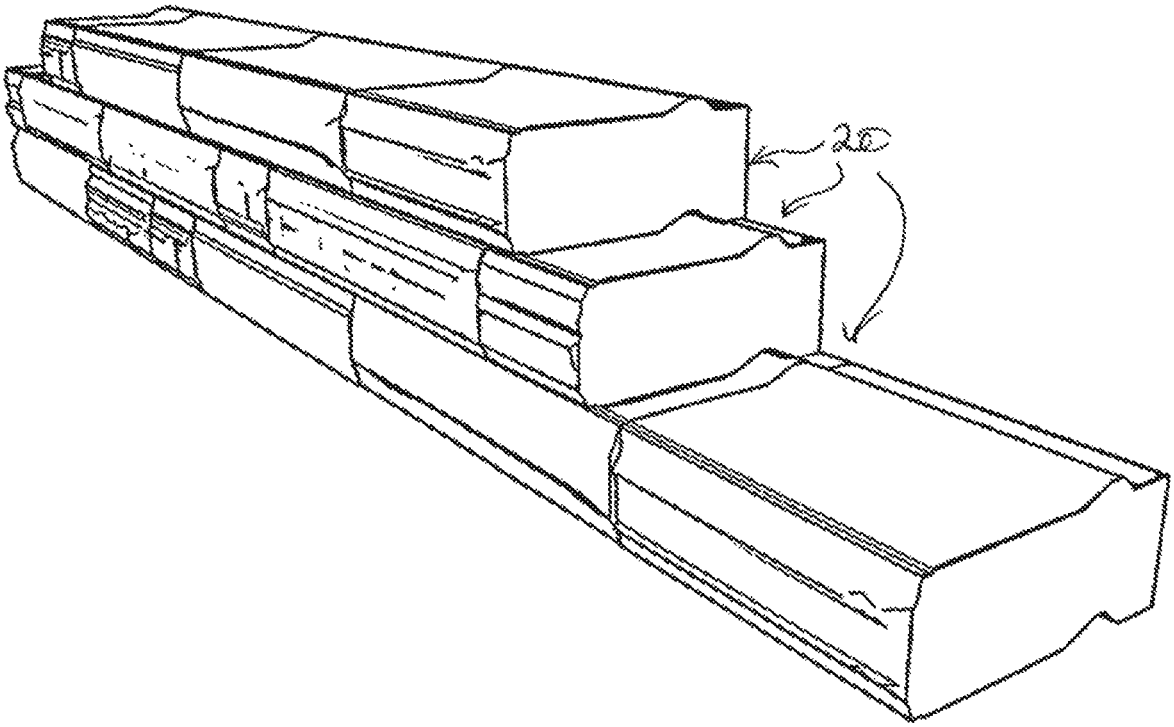
FIG. 22 is a perspective view of a retaining wall utilizing interlocking concrete blocks produced by the mold and method of the invention.

The projecting tongue 22*a* on the top 22 of the block 20 extends laterally (i.e. in the end-to-end direction), and the recess 24*a* complementary to the tongue 22*a* also extends laterally, providing a "tongue and groove interlock" which prevents one block 20 from shifting transversely relative to the block 20 immediately above or beneath in the wall structure, as best seen in FIG. 22. In the embodiment illustrated the interlocking structures 22*a*, 24*a* extend fully between the ends 26 of the block 20, however it will be appreciated that the interlocking structures 22*a*, 24*a* may extend partially between the ends 26 of the block 20. The precise length, height, shape and placement of the interlocking structures 22*a*, 24*a* is a matter of selection and is not limited by the particular embodiment illustrated.

In the preferred embodiment of the invention, the blocks 20 are oriented in the mold 30 such that the exposed face 28 of each block 20, defined herein as the face of the block 20 that is intended to be visible in the finished structure (for example a retaining wall), is disposed in a plane generally parallel to the top face 40 of the mold 30, preferably substantially flush with the top of the mold 30.

The mold 30 comprises a mold box 32, illustrated in FIGS. 2 to 6. In the example illustrated the mold box 32 comprises two end walls 34*a*, 34*b* joined to two side walls 36*a*, 36*b* to define a mold cavity 38. The bottom face 50 of the mold box 32 may be substantially open, since the mold box 32 will form a container when placed on a wooden board or other planar surface during casting. The top face 40 is open between partitions 42 and between the partitions 42 and the side walls 36*a*, 36*b*, which both allows for concrete to be poured evenly throughout the mold 30 and for the formation of the block faces 28, as described below.

Partitions 42 are configured and spaced from one another and from the side walls 36*a*, 36*b* to define the space between adjacent blocks 20, corresponding to the height H of the cast block 20 (indicated in FIG. 20). Partitions 42 extend between the end walls 34*a*, 34*b* of the mold box 32, substantially from the top face 40 (i.e. generally flush with the top face 40 of the mold box 32) partway into the mold cavity 38.

The mold 30 can be divided up to make any length of block 20 and/or number of blocks 20 up to the maximum mold size (typically determined by the size of the vibrating machine that will be used to assist in the compaction of the concrete). In the embodiment illustrated the mold box 32 is designed to form 3 rows of 6 blocks 20 per row. Within each row a block 20 is oriented with its top surface 22 facing the bottom surface 24 of the next adjacent block 20, while each row of blocks is disposed so that the blocks 20 are oriented end-to-end with the blocks 20 in the next adjacent row. To accomplish this, internal walls 44*a*, 44*b* are disposed extending between the side walls 36*a*, 36*b* of the mold box 32 and fully from the top face 40 to the bottom face 50 of the mold box 32 to completely separate the blocks 20 in one row from the blocks 20 in the adjacent row. As illustrated the internal walls 44*a*, 44*b* extend fully between the side walls 36*a*, 36*b* of the mold box and the partitions 42 are disposed between the walls 34*a* and 44*a*; 44*a* and 44*b*; and 44*b* and 34*b*, which effectively creates three isolated mold cavities 38*a*, 38*b* and 38*c*, respectively, within the mold box 32. Any other suitable configuration is possible, including casting most of the components as an integral unit, as described below.

The partitions 42 are configured to form a portion of the transverse profile of the top surface 22 of one block 20 and a portion of the transverse profile of the bottom surface 24 of an adjacent block 20 in the mold 30. In the embodiment shown, the partitions 42 form the top and bottom surfaces of the front portion F of the block 20 while the interlocking portion I and rear portion R of the block 20 (see FIG. 21) are formed by a removable mold insert 60, described in detail below.

The partitions 42 are accordingly provided on one side 42*a* with a profile that is a 'negative' of the transverse (face-to-rear) profile of the top surface 22 of the block 20 in the front portion F; and on the other side 42*b* with a profile that is a 'negative' of the transverse profile of the bottom surface 24 of the block 20 in the front portion F. In the embodiment shown, for example, the partitions 42 are provided on side 42*a* with a planar profile corresponding to the planar profile of the top surface 22 of the block 20 in the front portion F, extending from the block face 28 up to but not including the tongue 22*a*; while the other side 42*b* of the partition 42 is provided with a profile corresponding to the planar profile of the bottom surface 24 of the block 20 in the front portion F, extending from the block face 28 up to but not including the groove 24*a*.

The sides 36*a*, 36*b* of the mold box 32 are each provided with a profile corresponding to the bottom and top surfaces of the front portion F of the block 20, respectively. Specifically, the upper portion of side 36*a* is provided with a planar profile corresponding to the planar profile of the bottom surface 24 of the block 20 in the front portion F, extending from the block face 28 up to but not including the tongue 22*a*, and the upper portion of side 36*b* is provided with a profile corresponding to the planar profile of the top surface 22 of the block 20 in the front portion F, extending from the block face 28 up to but not including the groove 24*a*. The sides 36*a*, 36*b* are formed thicker than the partitions 42, in order to accommodate the mold insert 60 (as described below) while still being strong and rigid enough top offer the concrete containment functionality of the mold box 32 without swelling or distorting under the weight of the concrete.

Figure 16:
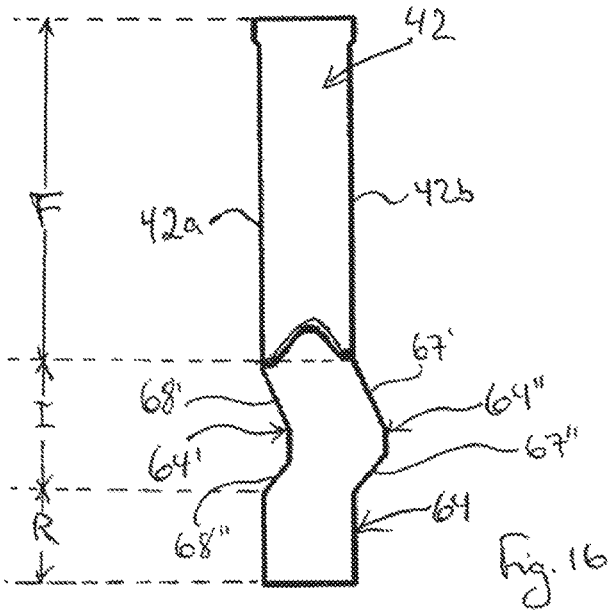
FIG. 16 is an enlarged cross-sectional end elevation of an intermediate finger engaging a partition in the mold insert of FIG. 7.
Figure 17:
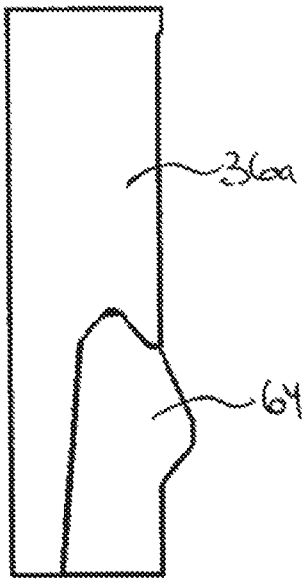
FIG. 17 is an enlarged cross-sectional end elevation of the left-most finger in FIG. 15 engaging the left side of the mold box.
Figure 18:
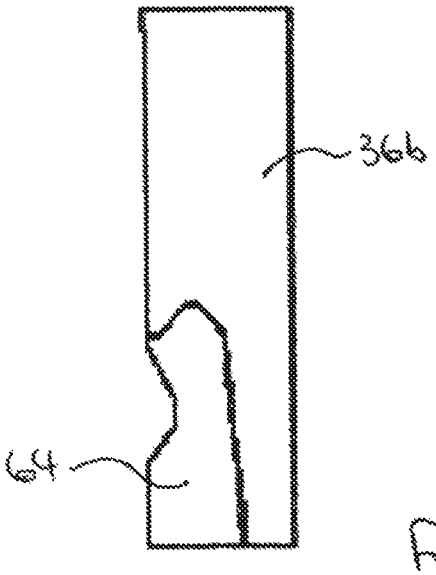
FIG. 18 is an enlarged cross-sectional end elevation of the right-most finger in FIG. 15 engaging the right side of the mold box.

The mold insert 60, illustrated in FIGS. 7 to 12, comprises a series of insert members 64. In the preferred embodiment the insert members 64 are connected together at one end by a connecting bar 62, for convenience, which may be provided with holes 62*a* for ease of grasping and manipulation by a user. In the embodiment shown insert members 64 are configured to define the space between the interlocking portions I and rear portions R of adjacent blocks 20, in the embodiment shown extending from the rear face 29 of the block 20 up to and including the front edges of the tongue 22*a* and recess 24*a*. Thus, in the embodiment shown the insert members 64 form the remainder of the transverse profiles of the top and bottom surfaces 22, 24 of the interlocking retaining wall block 20 which are not formed by the partitions 42 and side walls 36*a*, 36*b*, as best seen in FIG. 16.

At least one end wall 34*a* of the mold box 32 provides insert member openings 65 into which the insert members 64 are respectively received. The spacing between openings 65 matches the spacing between insert members 64, which is one advantage of connecting the insert members 64 together at a preset spacing, for example by a rigid connecting bar 62. The rigid connecting bar 62 also serves to maintain the insert members 64 in precise parallel alignment both when assembling the mold 30 for casting and when pouring the concrete. The insert members 64 could alternatively be connected in groups, or could be provided as separate unconnected members 64 for example by providing both ends 34*a*, 34*b* insert member openings 65 to hold the insert members 64 in parallel alignment. However, the embodiment shown is also advantageous both for the speed at which the mold insert 60 can be inserted into and retracted from the mold 30, and for the ability to automate these processes.

Ideally the profiles of the insert member openings 65 would be designed to closely match the cross-sectional profiles of the insert members 64, providing a seal in the assembled mold 30 that substantially prevents concrete from seeping out of the openings 65 when the mold insert 60 is in position in the mold 30. However, in the preferred embodiment the mold box 32 is capable of being lifted up off of and lowered down onto the mold insert 60 in a vertical direction, to facilitate an automated transition between casting cycles, as described below. Since the insert members 64 each include an undercut area 64' and a projection 64" (with the exception of the insert members 64*a*, 64*b* at each side wall 36*a*, 36*b*, which respectively include only one of the projection 64" or undercut 64'), the openings 65 in the end wall 36*a* of the mold box 32 must be a uniform width that is wider than the thickness of each insert member 64, so as not interfere with the lowering of the mold box 32 onto the insert members 64 in each casting cycle. As a result, when the mold 30 is assembled a gap remains in the end wall 36*a* of the mold box at the undercut portion 64' and beneath the projection 64" of the insert member 64. In order to prevent the seepage of the concrete mix out of the end wall 34*a* through these gaps, the portion of the length of the insert members 64 which will nest within the thickness of the wall 34*a* when the mold is assembled for casting are filled by filler blocks 66*a* and 66*b*, best seen in FIGS. 8 and 12, which close these gaps when the mold insert 60 is in the casting position in the mold box 32. The filler blocks 66*a*, 66*b* should preferably be formed in such a way that the concrete material does not stick to or accumulate around the filler blocks 64*a*, 66*b*, and the filler blocks 66*a*, 66*b* do not affect the surfaces of finished block 20, so in the preferred embodiment the inner edges of the filler blocks 64*a*, 66*b* extend flush to the inner wall of the mold box 32.

In an alternative embodiment (not shown), the openings 65 in the end walls 36 can be formed to match the profile of the insert members 64, including the undercut portions, and the concrete will be retained within the mold cavity 38 solely because of the close fit of the openings 65 around the insert members 64. In this embodiment the mold insert 60 must be both inserted into and withdrawn from the mold box 32 horizontally, and the mold box 32 therefore cannot be lowered vertically onto the mold insert 60 for casting which makes automation somewhat more complex.

Figure 10:
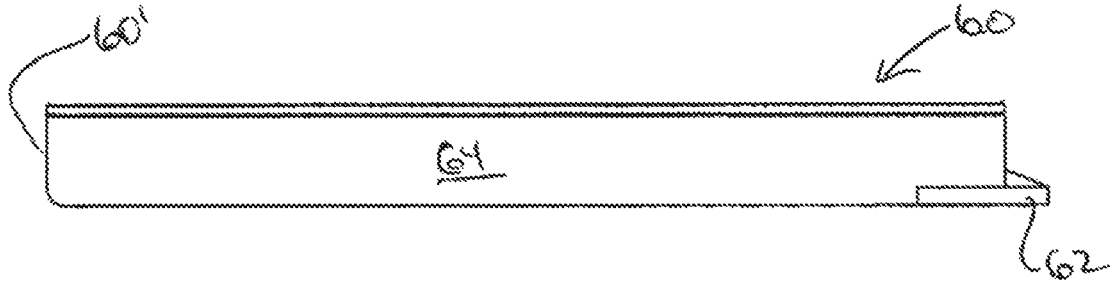
FIG. 10 is a side elevation of the mold insert of FIG. 7.
Figure 11:
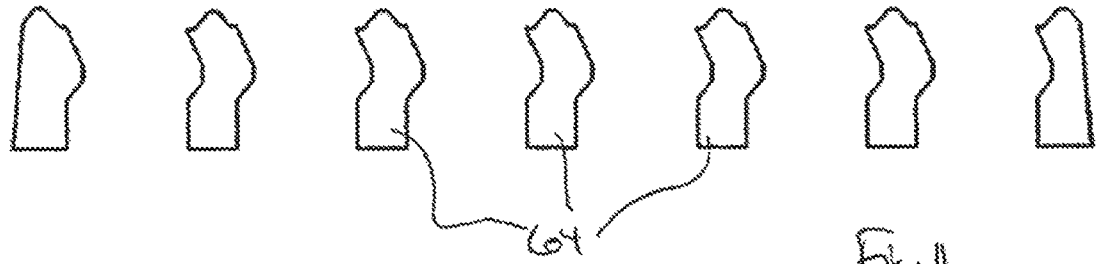
FIG. 11 is a cross-section of the mold insert taken along the line 11-11 in FIG. 9.
Figure 12:
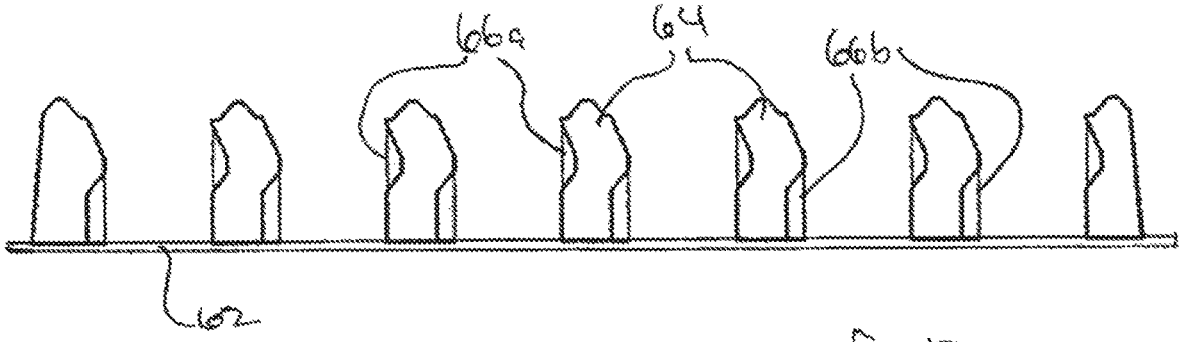
FIG. 12 is a cross-section of the mold insert taken along the line 12-12 in FIG. 9.

It will be appreciated that the insert members 64 extend fully between the end walls 34*a*, 34*b* of the mold box 32 in the embodiment illustrated because the tongues 22*a* and recesses 24*a* extend fully end-to-end across the blocks 20. Embodiments in which the interlocking structures do not extend fully between the ends 26 the blocks 20 are possible, for example where the insert members 64 extend only partway into the mold cavity 38, and fall within the scope of the invention. In either case, at the distal end 60' of the mold insert 60 the bottom edge of each insert member 64 advantageously merges into the distal edge of the insert member 64 along a curve, as best seen in FIG. 10, to act like the runner of a sleigh allowing the mold insert 60 to glide over the board or palette as the mold insert 60 is inserted into the mold box 32.

Figure 15:
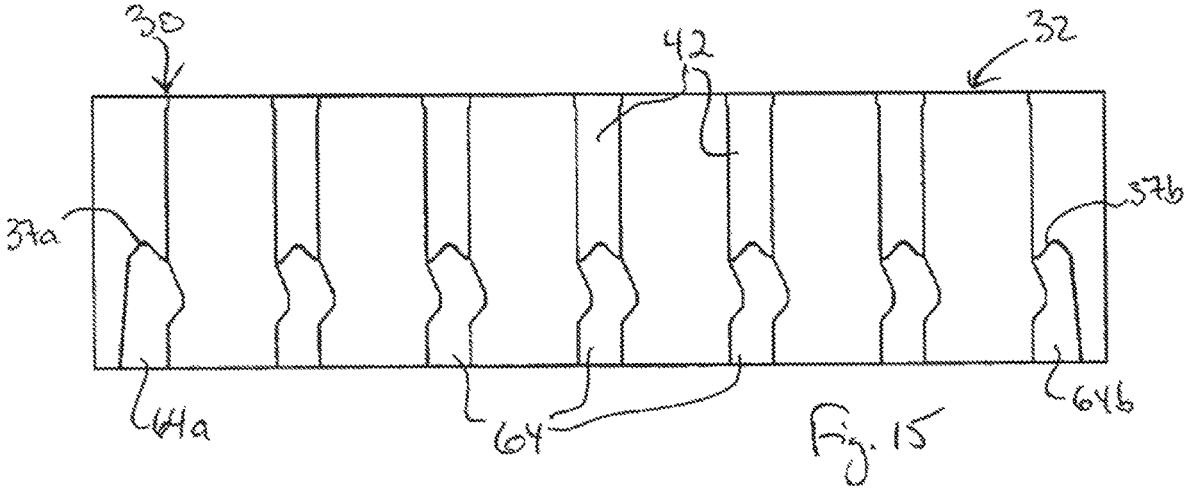
FIG. 15 is a cross-sectional end elevation of the mold insert in position in the mold box for casting.

As illustrated in FIGS. 15 and 16, in the preferred embodiment the top surface of each insert member 64 is keyed to mate with the congruent bottom surface of each partition 42 (or optionally in the case of the end insert members 64*a*, 64*b*, to a ledge 37*a* or 37*b* respectively formed in the side wall 36*a* or 36*b*). This ensures that in the assembled mold 30 the insert members 64 are retained against lateral shifting during casting, and that the top and bottom surface 22*a*, 24*a* of the block are level at the front portion F and rear portion R of the block 20 and lie in the same plane.

In the embodiment shown there is a small gap (e.g. 1 mm) left between the top surface of the insert member 64 and the bottom surface of the partition 42 (exaggerated for purposes of illustration on FIG. 16). This allows the insert members to slide in and out of the mold box 32, leaving only a small burr along the front of the tongue 22*a* that sits inside a void in the tongue 22*a* and thus will not become an obstruction when stacking the blocks 20 in a wall. Accordingly, in the preferred embodiment the top surface of each insert member 64 is provided with the projection, for example a laterally convex profile as shown, and the bottom surface of each partition 42 is provided with the congruent mating recess, so as to preclude any accumulation of casting material on the top of the insert members 64. However, other structural configurations that laterally interlock the insert members 64 to the partitions 42 can be used to effect the same result and are contemplated within the invention.

Figure 13:
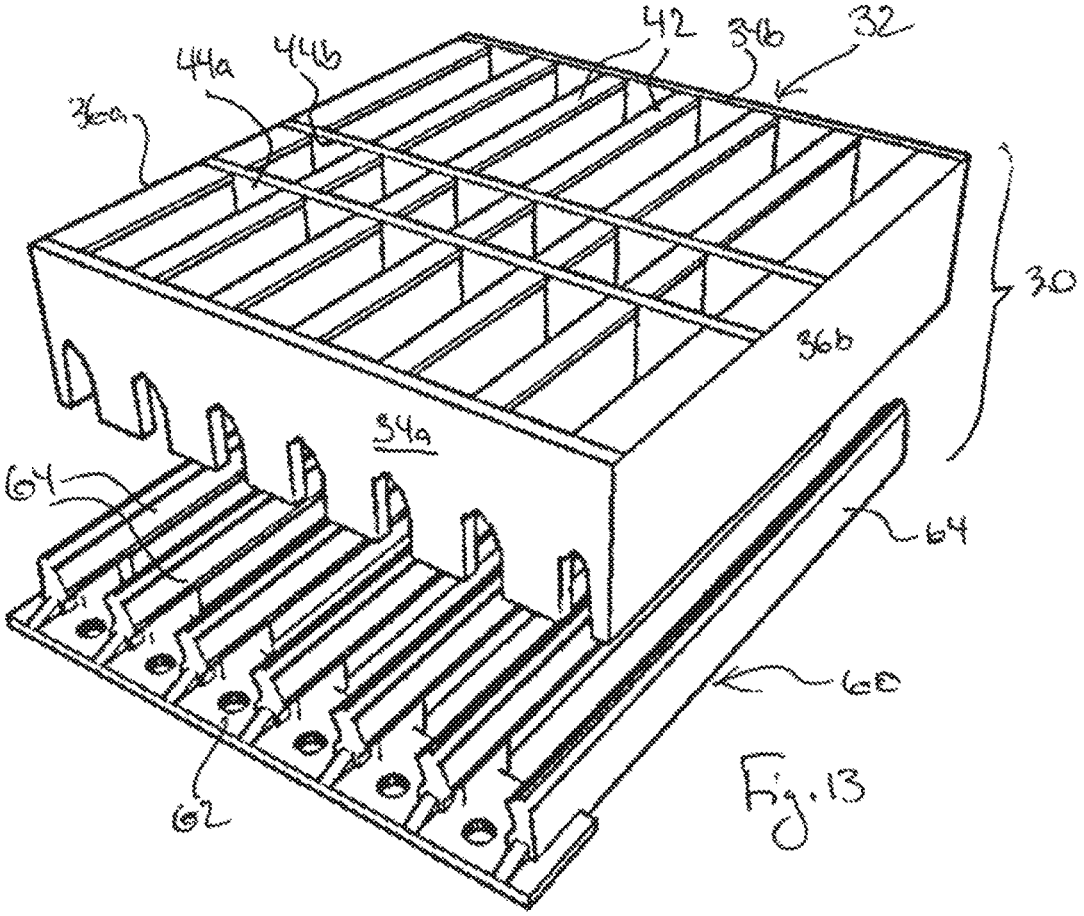
FIG. 13 is a perspective view of the mold box being lowered onto the mold insert.
Figure 14:
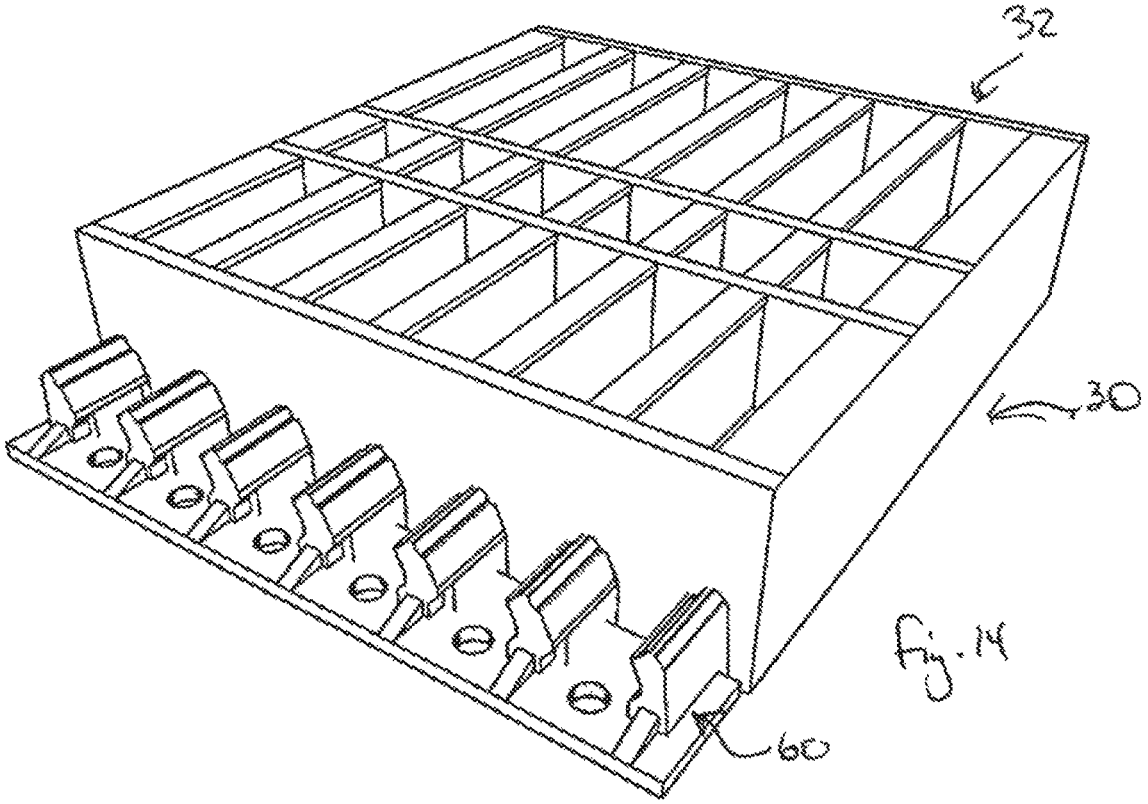
FIG. 14 is a perspective view of the mold box positioned on the mold insert for casting.

In the operation of the embodiment illustrated, the mold insert 60 is positioned on a planar surface, for example a floor, or a board or palette (not shown). The mold box 32 is disposed above the mold insert 60 as shown in FIG. 13, by aligning insert members 64 with their respective openings 65 in the end wall 34*a* of the mold box 32, until the mold box 32 is seated on the board (operatively associated with a vibrating machine, as is well known) which closes the open bottom face 50 of the mold box 32 in the casting position shown in FIG. 14. Concrete having the desired slump, preferably "dry" concrete for quick-setting purposes, is poured into the mold 30 generally evenly until the level of concrete substantially reaches the top face 40.

Figure 19A:
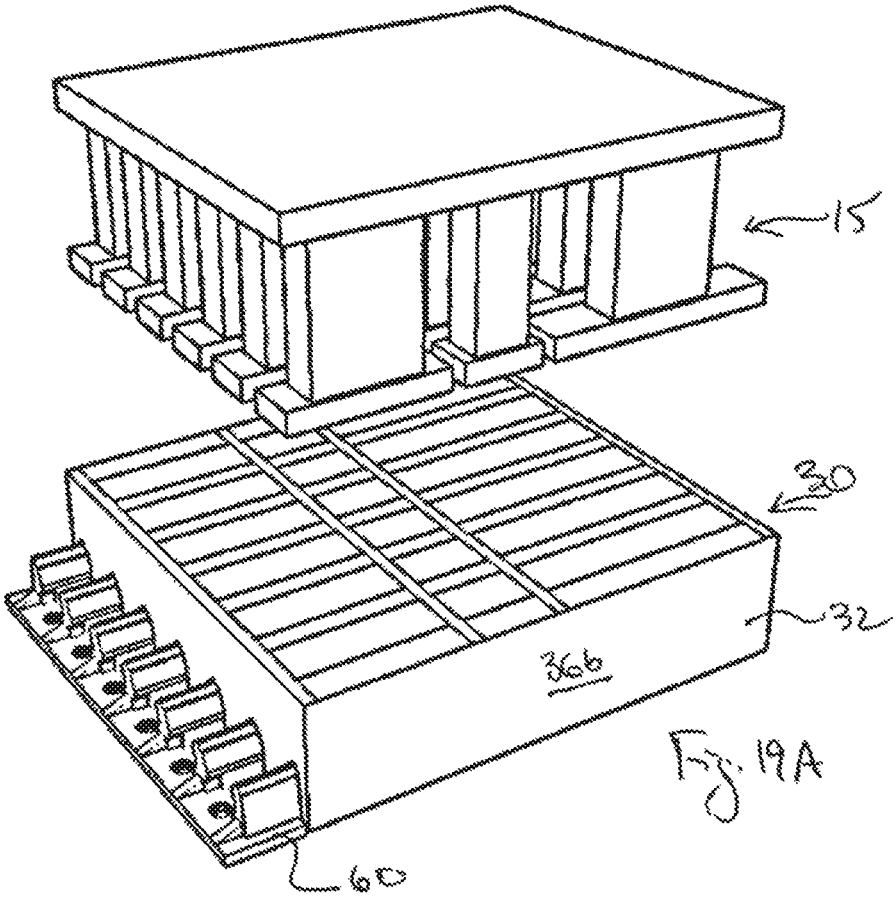
FIGS. 19A to 19F illustrate steps in the manufacture of concrete blocks according to an embodiment of the invention.
Figure 19B:
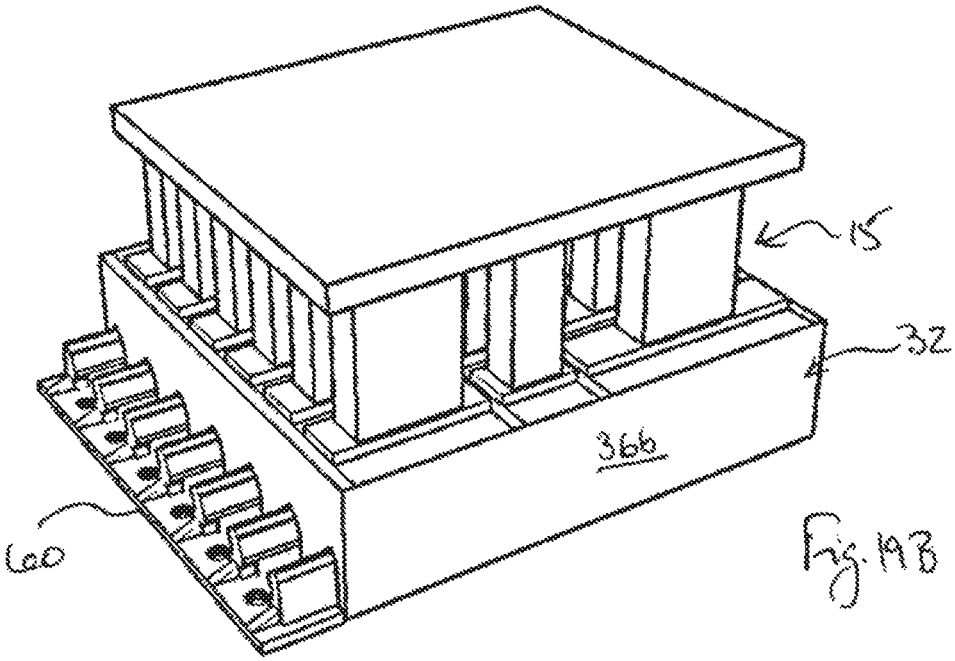
Figure 19C:
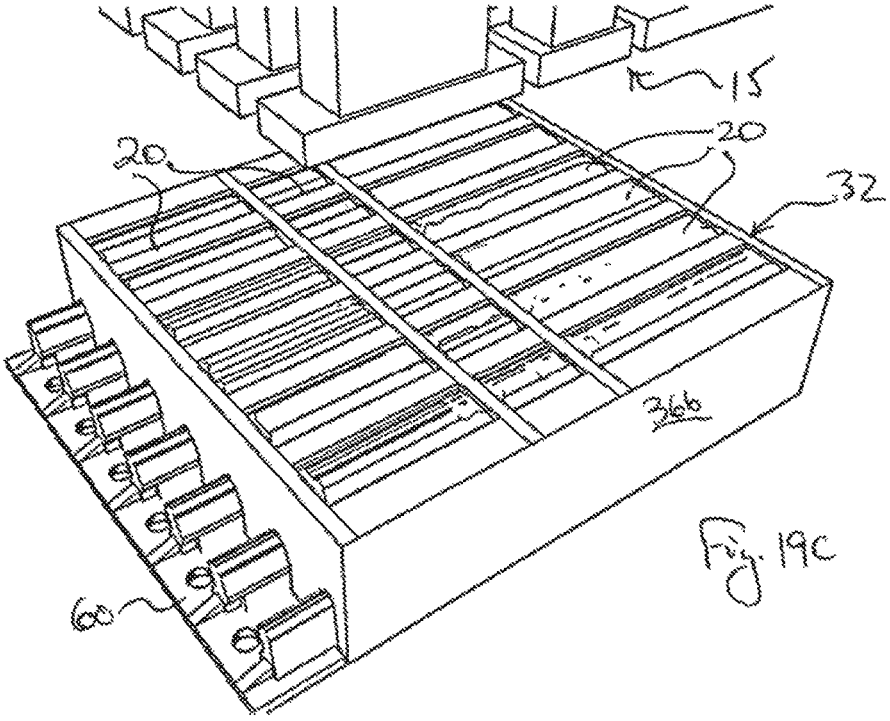
Figure 19D:
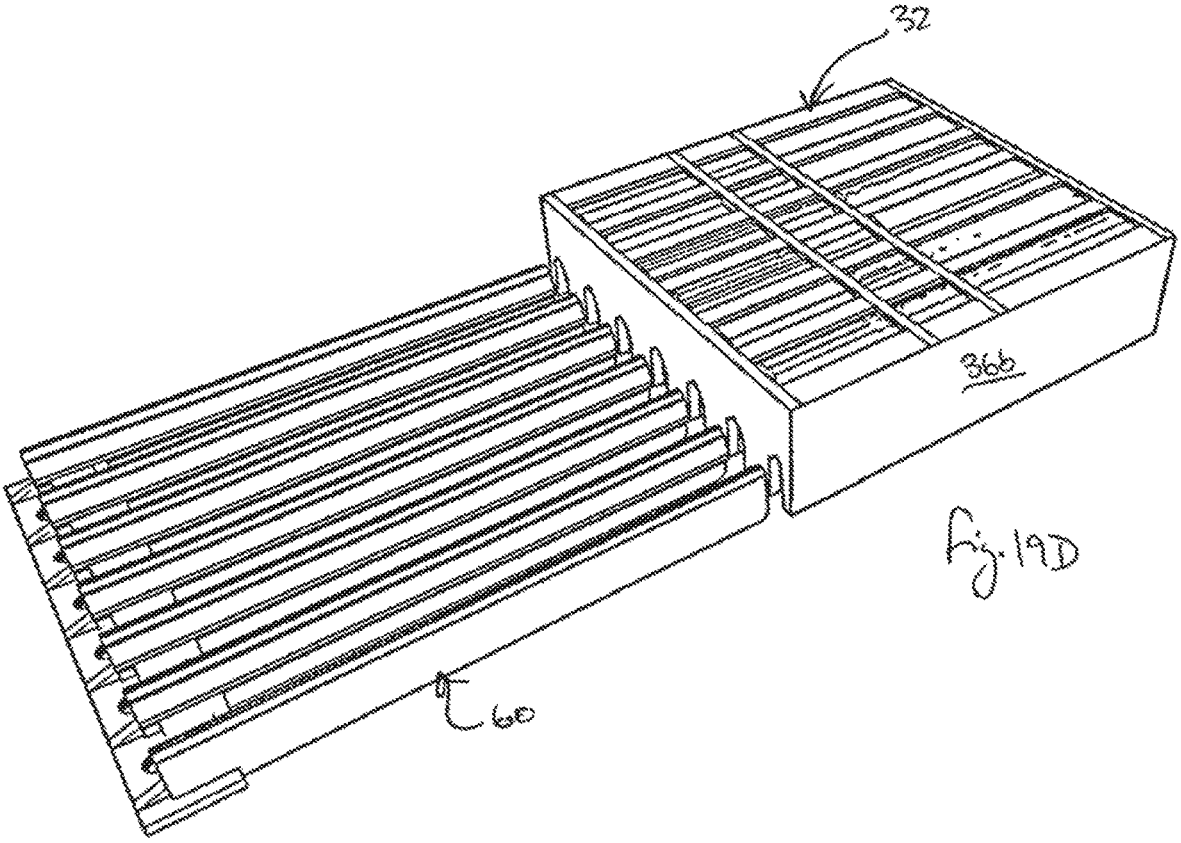

FIGS. 19A to 19F illustrate the face forming process. A press (not shown) is disposed over the mold 30, as shown in FIG. 19A, and the press head 15 is activated, as shown in FIG. 19B, to consolidate the concrete and, if desired, impart a texture and/or profile to the exposed faces 28 of the blocks 20 which is determined by the configuration and surface characteristics of the press head 15. The press head 15 is retracted, as shown in FIG. 19C. In the preferred embodiment the mold insert 60 is removed by drawing the mold insert 60 out of the end 34*a* of the mold box 32, as shown in FIG. 19D. Because of the uniform transverse profile of the blocks along the lateral extent of each block 20, the mold insert 60 can be removed laterally from the mold box 32 substantially unimpeded by the interlocking structures formed on the concrete blocks 20.

Figure 19E:
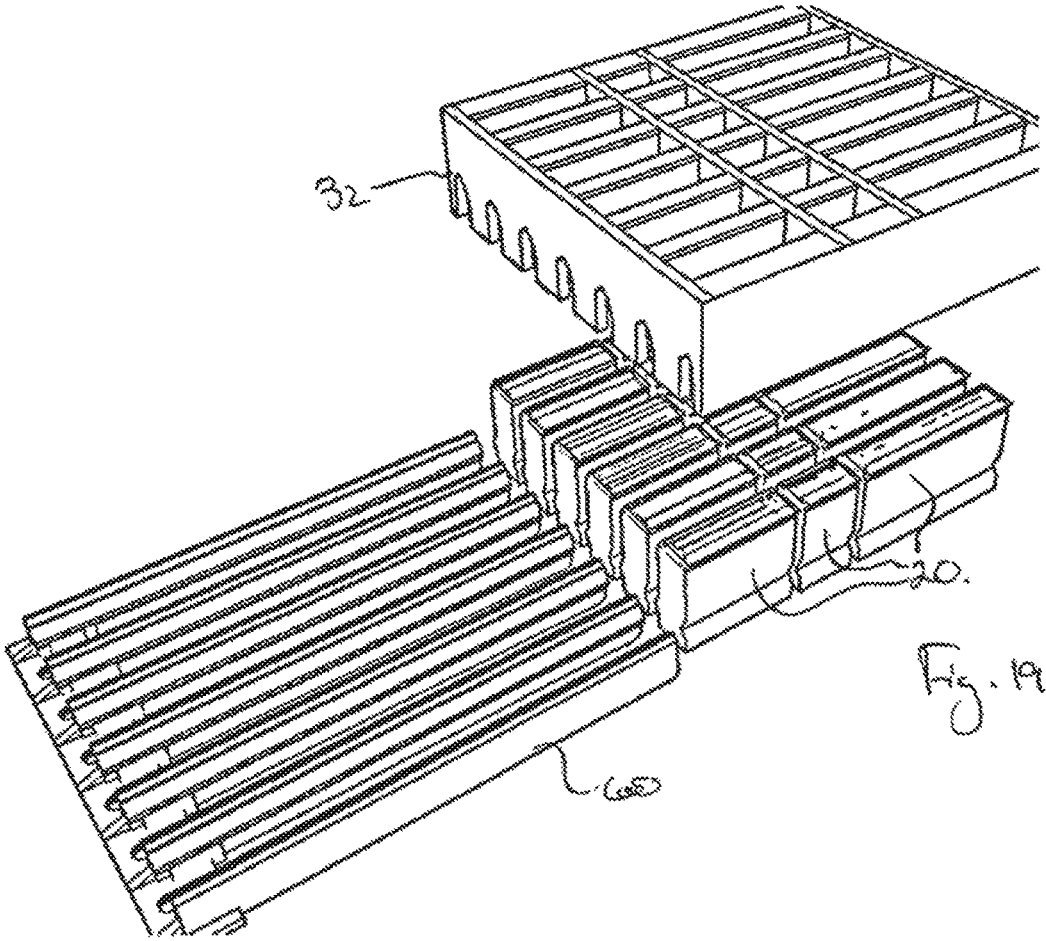
Figure 19F:
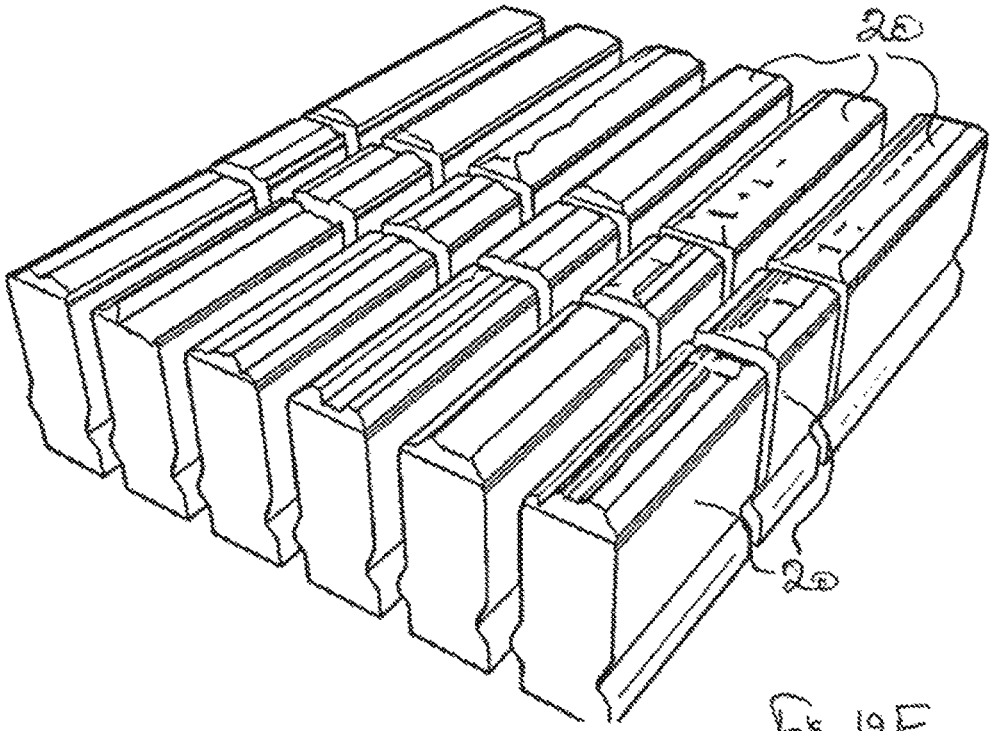

The mold box 32 can then be lifted off of the newly formed blocks 20, as shown in FIG. 19E. Because there is no positive interlock between the partitions 42 and the front portions F of the blocks 20, the mold box 32 can be lifted off of the concrete blocks 20 without obstruction. The front portion F of each block 20 formed by the partitions 42 (and on the ends, side walls 36*a*, 36*b* of the mold box 32) is selected so that no portion of the top 22 or bottom 24 of the block interlocks in a vertical direction with the partitions 42. The result is a course of blocks 20 standing on the board face-up, as shown in FIG. 19F. The newly formed blocks 20 can then be pushed together and stood upright (i.e. top surfaces 22 up), to be placed on a skid for shipping.

It is advantageous to slide the mold insert 60 out from under the newly formed blocks 20 while the mold box 32 is still in position holding the blocks 20 in place. Alternatively, the mold box 32 can be lifted first and the blocks 20 held in position by other means as the mold insert 60 is drawn out from underneath the blocks.

The components of the mold 30 may be formed from steel or any other suitable material. The components of the mold box 32 may be bolted together, welded or affixed by any other suitable means. Some components of the mold box 32 may be cast integrally using conventional metal casting techniques; for example, in the embodiment illustrated the side walls 36*a*, 36 can optionally be formed integrally with the internal walls 44*a*, 44*b* and partitions 42 (for example, top-down) and the end walls 34*a*, 34*b* formed separately and subsequently bolted or otherwise affixed to the side walls 36*a*, 36*b*.

The embodiment illustrated is dimensioned to cast three concrete blocks 20 per row, which blocks 20 may be of varying lengths. However, the mold 30 can be designed to cast fewer or more concrete blocks 20 as desired, the components of the mold 30 being provided with thicknesses suitable for withstanding the weight of the concrete without deforming during casting. It will be appreciated that since the components of the mold box 32 and mold insert 60 combine to form parallel surfaces, increased accuracy of mold construction and manufacturing may be required.

It will be appreciated that although the blocks 20 are illustrated as oriented in the same direction in the mold 30, because of the versatility in providing profiles on the insert members 62 the blocks 20 can be oriented in the mold 30 in different directions, for example some facing tongue-to-tongue and others oriented tongue-to-groove as shown.

Different types of interlocking structures may be formed using the mold 30 of the invention. However, because the blocks 20 are cast in a face-up orientation in the mold 30 and the concrete used is preferably is dry cast—i.e. has a low slump (water content), preferably the minimum amount of water required to make the concrete flow when cast but become free standing within 5 seconds of being compacted, there are factors that make the particular tongue-and-groove interlocking configuration illustrated advantageous. The dry cast concrete must be able to flow fully into any undercut structure, essentially any structure disposed beneath an outcropping, for example surfaces 67" and 68' which respectively form the rear surface of the groove 24*a* and the front surface of the tongue 22*a*, as shown in FIG. 16. Undercut regions of the interlocking portion I are therefore preferably designed to strike a balance between creating a reasonably strong and stable interlock and ensuring substantial compaction in the area beneath each undercut.

Thus, the tongue 22*a* may be formed asymmetrically in cross-section, as in the embodiment shown in which the front surface of the tongue 22*a* is formed at a shallower angle than the rear surface of the tongue 22*a*, respectively by surface 68' of the insert member 64 which is at a shallower angle than the surface 68" that forms the rear surface of the tongue 22*a*. The rear surface of the tongue 22*a* is the "locking" side, creating the shear resistance between the top surface 22 of a lower block 20 and the bottom surface 24 of the upper block 20 resting on the lower block 20, so for a more positive interlock it is desirable to have the rear surface of the tongue 22*a* inclined as steeply as possible from the horizontal. Depending on the board machine, concrete mix, and the pre-vibration and main vibration applied to the mold during the casting process, the inclination of the rear surface of the tongue 22*a* may range from between 30 to 45 degrees from the vertical. Testing and experience indicates that this angle allows compaction efforts above to transfer the pre-set concrete mixture into the undercut regions, albeit potentially to a lesser extent than the remaining regions within the mold 30. This also has the advantage of rendering the tongue 22*a* self-supporting immediately follow extraction from the mold 30, when the concrete is in an uncured state. The shallow front angle of the tongue 22*a* reduces the amount of material required to form the tongue 22*a*, and thus its weight, to ensure that when the cast block 20 is standing vertically in an uncured state the tongue 22*a* remains intact and does not slump or distort.

The rear surface of the tongue 22*a* is formed at a significantly steeper angle by surface 68" than the front surface of the tongue 22*a*, in order to ensure a positive, stable interlock. At the same time the projection 64", which will form the groove 24*a* in the finished block 20, surface 67" forming the rear surface of the groove 24*a* must complement the angle of the rear surface 68" of the undercut 64', and is thus formed steep enough to serve as a corbel (for example as indicated above 30 to 45 degrees) while still allowing the undercut portion beneath the projection 64" to fill fully with concrete during casting.

It will be appreciated that the particular portions of the block 20 which may be formed by the respective partitions 42 and insert members 64 may differ from those that are illustrated herein solely by way of example of a preferred embodiment.

Although in the embodiment illustrated the projecting and undercut portions 22*a*, 24*a* of the top and bottom surfaces 22, 24 (i.e. the tongue 22*a* and groove 22*b* in the embodiment shown) are formed by the removable insert 60, it will be appreciated that it is possible to extend the partitions 42 down on one side to form the front portion of the tongue structure 22*a*, and/or for the insert members 64 to form part of the front portion F of the block 20, without affecting the operation of the invention.

Various embodiments of the present invention having been thus described in detail by way of example, it will be apparent to those skilled in the art that variations and modifications may be made without departing from the invention. For example, although less advantageous than the preferred embodiments, the blocks 20 could be formed in the mold with their exposed faces 28 at the bottom of the mold while still providing some advantages of the invention. The invention includes all such variations and modifications as fall within the scope of the appended claims.

The invention claimed is:

1. A method of manufacturing a plurality of interlocking concrete retaining wall blocks each having a top surface having a transverse profile comprising at least one interlocking structure projecting from the top surface and a bottom surface having a transverse profile comprising at least one complementary interlocking structure recessed into the bottom surface, comprising the steps of:

a. providing a mold box comprising two side walls joined to end walls to define a mold cavity, a top face, and a substantially open bottom face; and partitions configured to define a space between adjacent blocks or a space between a block and a side of the mold box, wherein the partitions extend substantially parallel to the two side walls of the mold box substantially from the top face of the mold box into the mold cavity; at least a longitudinal portion of at least some of the partitions being configured to form a first transverse portion of the transverse profile of the top surface of one block or a first transverse portion of the transverse profile of the bottom surface of an adjacent block or both, wherein the first transverse portions do not include any undercut portion that would impede removal of the mold box in a substantially vertical direction; and at least one removable insert comprising insert members which, when positioned in the mold box beneath the partitions, extend substantially parallel to the two side walls and are configured to occupy the space between adjacent blocks or the space between a block and a side of the mold box, for forming a remaining transverse portion of the transverse profile of the top surface of one block; wherein the remaining transverse portion includes one undercut portion;

b. inserting the insert members into openings in an end of the mold box, such that top surfaces of at least some of the insert members are in substantially lateral alignment with respective bottom surfaces of at least some of the partitions;

c. introducing concrete into the mold cavity;

d. consolidating the concrete;

e. and in any order:

i. removing the insert members from the mold box; and ii. removing the formed blocks from the mold box.

2. The method of claim 1, further comprising, during or after step d., actuating a press head to impart a profile or texture or both to exposed faces of the blocks.

3. The method of claim 2, wherein the step of removing the formed blocks from the mold box comprises the step of lifting the mold box off of the formed blocks.

4. The method of claim 2, wherein the step of removing the insert members from the mold box comprises the step of lifting the mold box off of the insert members.

5. The method of claim 2, wherein the step of removing the insert members from the mold box comprises the step of retracting the insert members from the mold box in a lateral direction.

6. The method of claim 1, wherein the mold box comprises internal walls extending substantially parallel to the end walls of the mold box for manufacturing a plurality of interlocking concrete blocks between the end walls.

* * * * *